US006036295A

United States Patent [19]

Ando et al.

[11] Patent Number: 6,036,295

[45] Date of Patent: Mar. 14, 2000

[54] INK JET PRINTER HEAD AND METHOD FOR MANUFACTURING THE SAME

[75] Inventors: Makoto Ando, Tokyo; Takaaki Murakami, Kanagawa, both of Japan

[73] Assignee: Sony Corporation, Japan

[21] Appl. No.: 08/346,162

[22] Filed: Nov. 21, 1994

[30] Foreign Application Priority Data

Nov. 26, 1993 [JP] Japan ..... 5-321246

[51] Int. Cl.[7] ..... B41J 2/195

[52] U.S. Cl. ..... 347/7; 347/15; 347/84; 347/95

[58] Field of Search ..... 347/20, 21, 66, 347/67, 54, 84, 95, 7, 15

[56] References Cited

U.S. PATENT DOCUMENTS

| | | | |
|---|---|---|---|
| 3,930,260 | 12/1975 | Sicking | 347/68 |
| 4,017,869 | 4/1977 | Meyer et al. . | |
| 4,494,128 | 1/1985 | Vaught | 347/21 |
| 4,580,148 | 4/1986 | Domoto et al. | 347/63 |
| 4,614,953 | 9/1986 | Lapeyre | 347/43 |
| 4,839,666 | 6/1989 | Jayne | 347/5 |
| 4,882,596 | 11/1989 | Tsuzuki et al. | 347/10 |
| 5,119,116 | 6/1992 | Yu | 347/65 |
| 5,371,529 | 12/1994 | Eguchi et al. | 347/7 |
| 5,539,437 | 7/1996 | Penwell | 347/54 |
| 5,606,351 | 2/1997 | Hawkins | 347/15 |

FOREIGN PATENT DOCUMENTS

| | | | |
|---|---|---|---|
| 0 538 147 | 4/1993 | European Pat. Off. . | |
| 1-297259 | 11/1989 | Japan | 347/15 |
| 5201024 | 8/1993 | Japan . | |
| 406071881 | 3/1994 | Japan | 347/21 |

*Primary Examiner*—John Barlow
*Assistant Examiner*—Craig A. Hallacher
*Attorney, Agent, or Firm*—Rader, Fishman & Grauer; Ronald P. Kananen

[57] ABSTRACT

An ink jet printer head and an ink jet printer which express a half tone with a simple construction in accordance with the density data. The ink 13 and the transparent solvent 10 are quantified and mixed based on the density data for each of the specified pixels, and the liquid ink drop mixture is deposited onto a recording medium, so as to deposit a predetermined density of the liquid ink drop onto the recording medium based on the density data for each of the specified pixels. Therefore, a half tone can be represented with certitude in accordance with density data with a simple construction.

28 Claims, 38 Drawing Sheets

1 ST PIEZO ELEMENT (DISCHARGE SIDE)

2 ND PIEZO ELEMENT (QUANTIFYING SIDE)

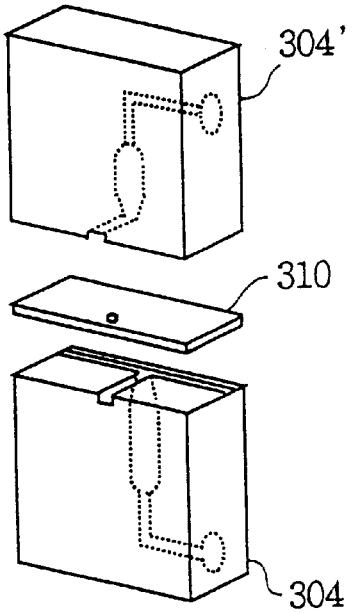
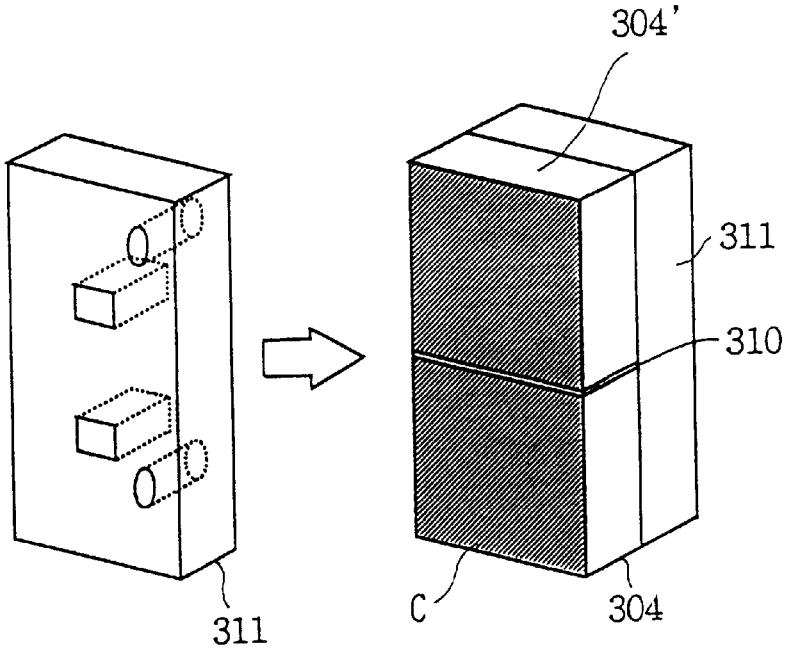
FIG. 22 A
FIG. 22 B

INK JET PRINTER HEAD AND METHOD FOR MANUFACTURING THE SAME

BACKGROUND OF THE INVENTION

1. Field of the Invention

This invention relates to an ink jet printer head and an ink jet printer, and more particularly to an improvement in a so-called "on-demand" type ink jet printer that can print a half tone.

2. Description of the Related Art

Conventionally, the on-demand type ink jet printer takes the form of a printer for discharging liquid ink drop from the nozzle in accordance with a recording signal to print the material to be printed on a recording medium such as paper or film. Such a type of printer is becoming more and more widely used simply because the size of the printer can be reduced and the cost thereof can be reduced as well.

At the same time, particularly in offices, document preparation using a computer often referred to as desktop publishing has become very popular. Quite recently, requirements have grown more and more strong not only for outputting characters and figures but also for outputting natural color images such as photographs together with characters and figures. For printing such high-quality natural images, a half tone representation is very important.

In such on-demand ink jet printers, methods have become very popular which uses a piezo element, or which uses a heating element. The method which uses the piezo element involves applying pressure to the ink through the distortion of the piezo element to discharge the ink from the nozzle. The method which uses the heating element involves localized heating and boiling the ink with the heating element to discharge the ink with the pressure of the bubbles thus generated.

In addition, ink jet printers are available which vary a voltage and a pulse width to be given to the piezo element or the heating element and control a liquid ink drop that is discharged to render variable the diameter of printing dots and thus provide a gradation representation. Ink jet printers are also available which provide gradation representation in matrixes using the dithering method by constituting one pixel with a matrix comprising, for example, 4×4 dots without changing the dot diameter.

However, as described above, in the on-demand ink jet printer, the method for changing a voltage and pulse width applied to the piezo element or the heating element has the following drawbacks: when the voltage and the pulse width applied to the piezo element and the heating element are excessively lowered, ink cannot be discharged, meaning that the minimum liquid drop diameter is limited. Consequently, the number of gradation levels that can be represented is low. Low-density representation in particular cannot be done. The method is thus unsatisfactory, practically speaking for printing out natural images.

When one pixel is constituted, for example, of 4×4 matrixes with the method for gradation representation using the dithering method, 17 gradation levels can be represented. However, the material to be printed is printed in the same dot density as the above method, the resolution will deteriorate only to one fourth, so that the roughness of the printed characters becomes apparent. In such a case, the method is unsatisfactory, practically speaking, for printing out natural images.

To solve such problems, an ink jet printer, which discharges a mixed liquid obtained by quantifying and mixing transparent solvent and ink to perform printing, has been provided. In this type of ink jet printer, one of the transparent liquid solvent and the ink, for example, ink is quantified to obtain a desired gradation, the quantified ink is mixed with other liquid, for example, transparent solvent, and the mixed liquid is discharged as a fixed amount to perform printing. That is, printing is performed by in-dot density gradation.

As an ink jet printer for printing by using mixed liquid that ink and transparent solvent are mixed, an ink jet printer has been provided in which ink and transparent solvent is quantified and mixed by utilizing an electrical permeation technique (Japanese Patent Laid Open No. 201024/1993 (U.S. Pat. No. 961,982)). Here, the electrical permeation is a phenomenon wherein electrolyte solution moves through a porous barrier membrane, when a porous barrier membrane is provided to partition a vessel filled with electrolyte solution into two, for example, into right and left, chambers and electrode plates are put into respective partitioned electrolyte solution to apply voltage.

Since the permeation amount (movement amount) of the electrolyte solution is proportional to the voltage when electrical permeation is used, the relatively accurate quantifying and mixing can be performed. However, because the frequency response of the electrical permeation is lower than, for example, a piezo element or a heat generating element, it has been difficult to realize high speed printing. Moreover, there has been a problem that because the electrolyte solution is used in the electrical permeation, if water is used as transparent solvent, it is electrolyzed and bubbles are generated.

SUMMARY OF THE INVENTION

In view of the foregoing, an object of this invention is to provide an ink jet printer head and an ink jet printer which can print a half tone accurately with a simple construction in accordance with a density data.

The foregoing objects and other objects of the invention have been achieved by the provision of an ink jet printer head comprising: quantifying and mixing means 2, 3, 4, and 5 for quantifying and mixing ink 13 or a transparent solvent to the transparent solvent 10 or the ink by controlling first pressure giving means 9, 17 in accordance with given density data; and liquid discharge means 1 for discharging a liquid ink drop being a liquid mixed by the quantifying and mixing means 2, 3, 4, and 5 by controlling second pressure giving means 8, 16 to deposit the ink on a recording medium, so that a half tone is printed by the density modulation of the liquid ink drop.

Further, this invention provides an ink jet printer having an ink jet printer head comprising: quantifying and mixing means 36, 37, and 38 for quantifying and mixing ink 32 or a transparent solvent with the transparent solvent 31 or the ink by controlling first pressure giving means 34 in accordance with given density data; and liquid discharge means 35 for discharging a liquid ink drop being a liquid mixed by the quantifying and mixing means 36, 37, and 38 by controlling second pressure giving means 33 to deposit to a recording medium, so that a half tone is printed by the density modulation of the liquid ink drop.

Further, this invention provides an orifice plate 406 on which a resist pattern and a metal pattern of electroplating are repeatedly formed as multi-layer, the orifice plate comprising: a cylindrical mixing room 37 for quantifying and mixing ink 32 and transparent solvent 31; a first orifice 35 formed on the bottom surface of the mixing room 37 in which the transparent solvent 31 or the ink is discharged; a second orifice 36 formed on the side plane of the mixing room 37 in which the ink 32 or the transparent solvent is discharged; a mixing channel 38 for introducing the ink 32 or the transparent solvent to the second orifice 36.

This invention can actualize an ink jet printer head and an ink jet printer that can deposit a predetermined density of a liquid ink drop to represent a half tone representation with certitude in accordance with the density data with a simple construction by quantifying and mixing the ink and the transparent solvent in accordance with density data for each of the given pixels and to deposit the mixed liquid ink drop onto a recording medium.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIGS. 22A and 22B are exploded schematic perspective views showing the steps involved in fabricating the ink jet printer head according to this invention;

DETAILED DESCRIPTION OF THE EMBODIMENT

Figure 1:
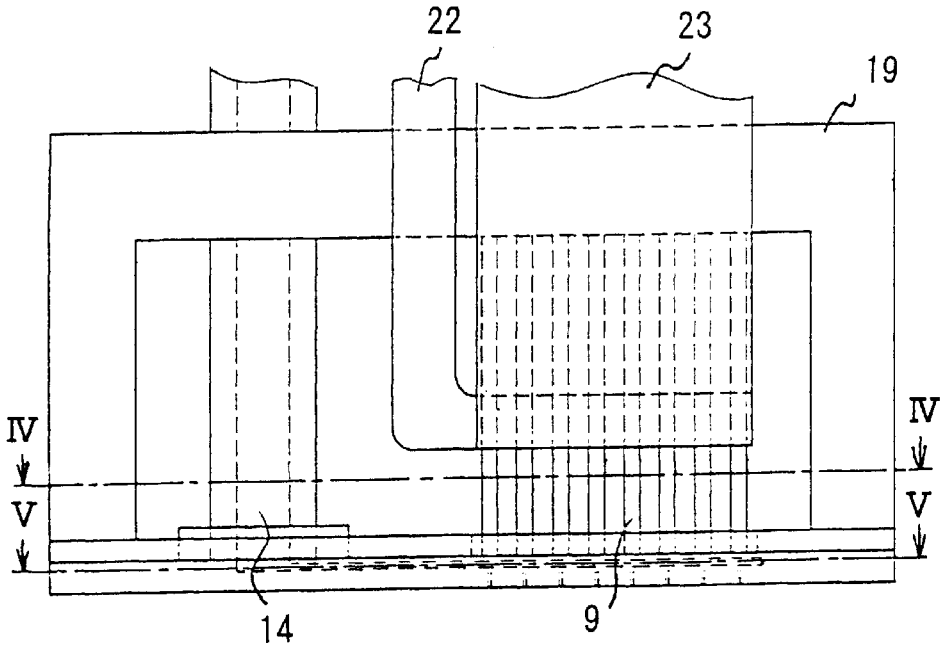
FIG. 1 is a top plan view showing the construction of an ink jet printer head according to the first embodiment of this invention, the head seen from the side of the printing surface.
Figure 2:
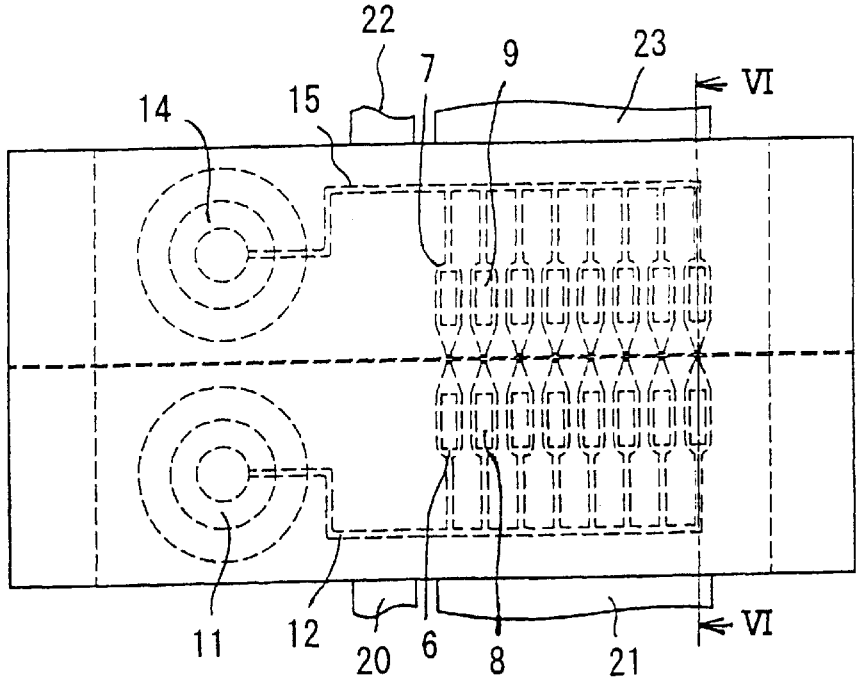
FIG. 2 is a front view showing the construction of the ink jet printer head shown in FIG. 1.
Figure 3:
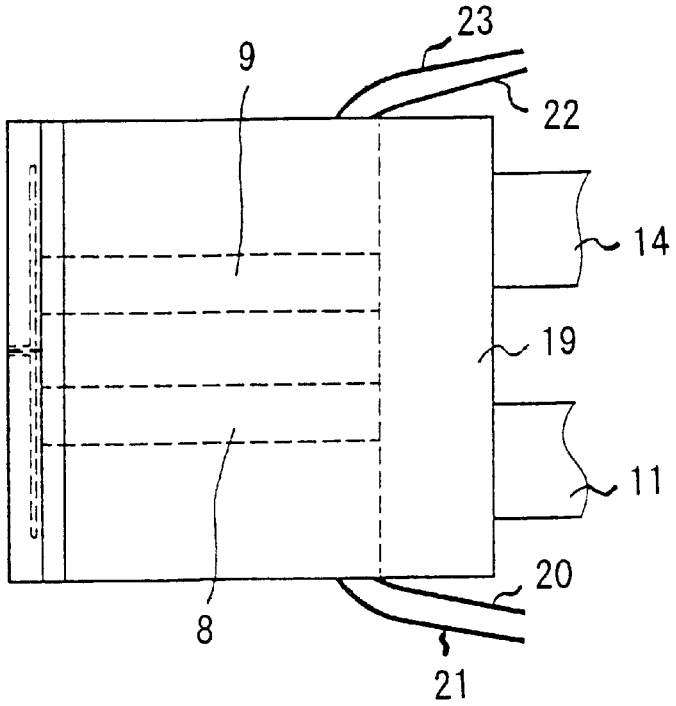
FIG. 3 is a right-side view showing the construction of the ink jet printer head of FIG. 1.
Figure 4:
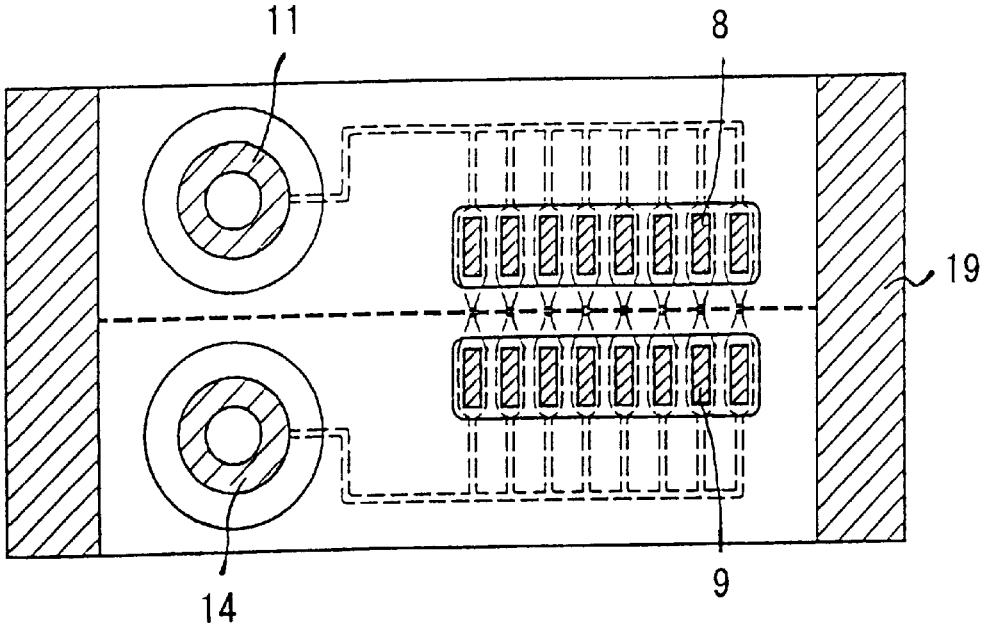
FIG. 4 is a sectional view of the ink jet printer head of FIG. 1 taken along line IV—IV.
Figure 5:
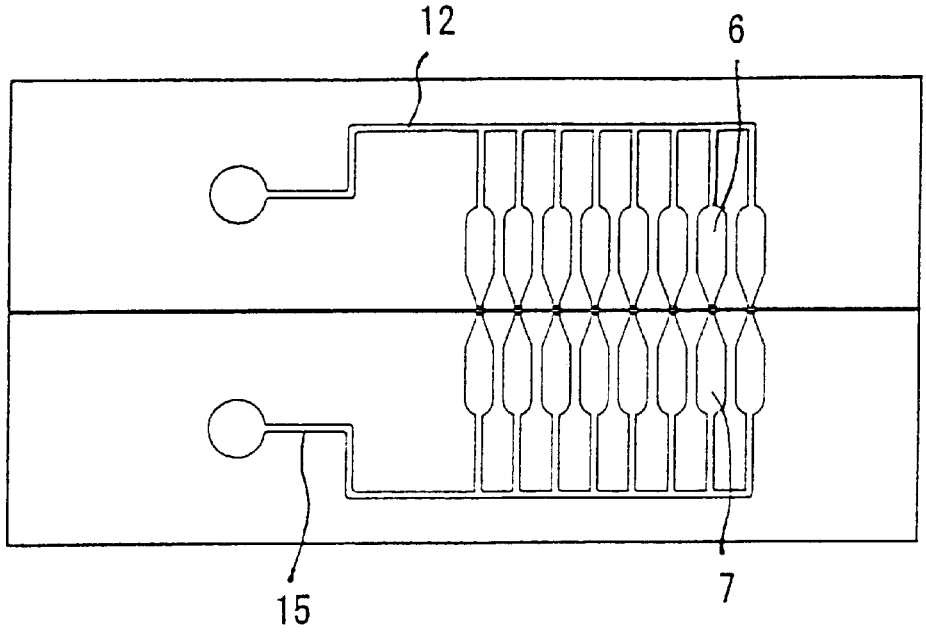
FIG. 5 is a sectional view of the ink jet printer head of FIG. 1 taken along line V—V.
Figure 6:
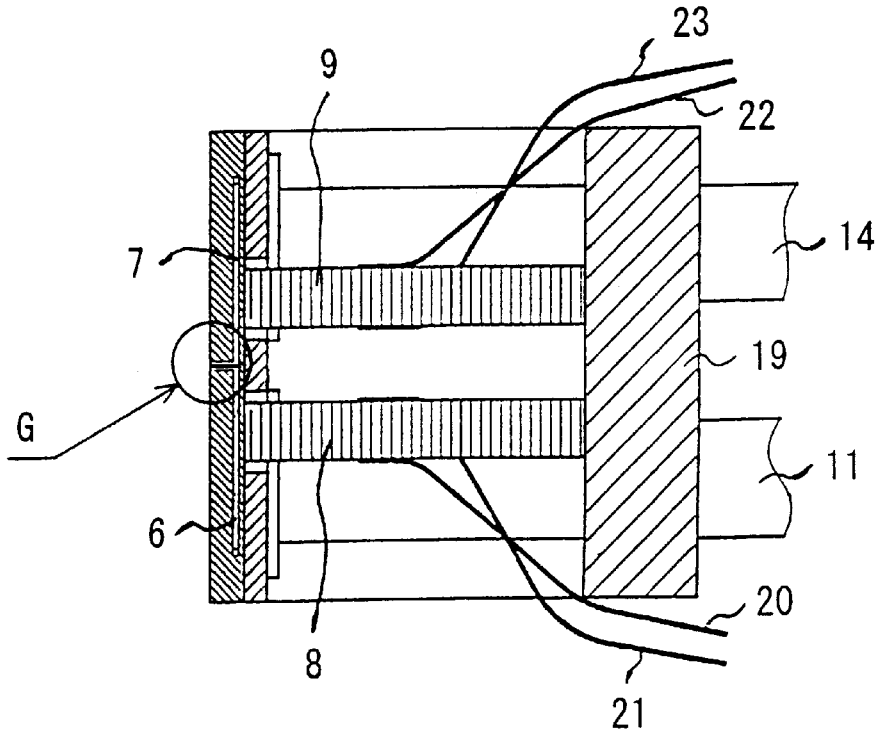
FIG. 6 is a sectional view of the ink jet printer head of FIG. 2 taken along line VI—VI.
Figure 7:
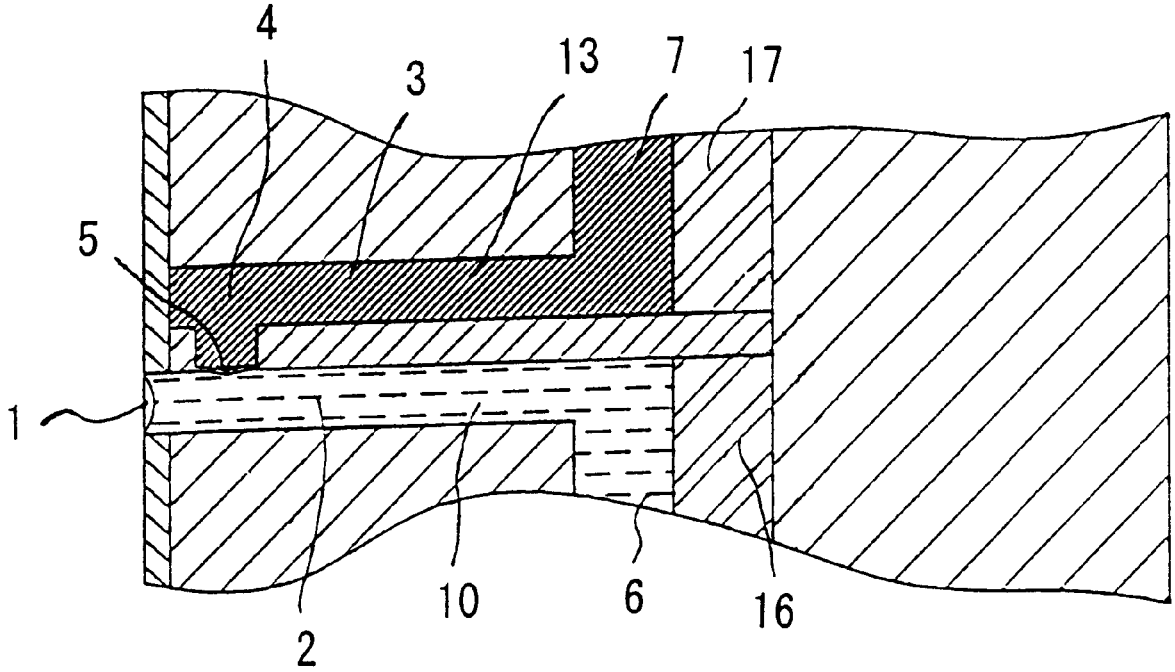
FIG. 7 is an enlarged sectional view of the nozzle section of the ink jet printer head of FIG. 1.

Preferred embodiment of this invention will be described with reference to the accompanying drawings:

(1) Ink Jet Printer Head using Piezo Element (1-1) The first embodiment of ink jet printer head FIGS. 1 to 3 are a top view, front view, and right side view of the ink jet printer head according to this invention. FIGS. 4 to 6 are sectional views of the ink jet printer head. FIG. 7 is an enlarged sectional view of discharge nozzle section G. Referring to FIGS. 1 to 7, the numeral 1 indicates an orifice, 2 indicates a first nozzle, 3 indicates a second nozzle, 4 indicates a mixing hole, 5 indicates a unidirectional valve, 6 indicates a first cavity, 7 indicates a second cavity, 8 indicates a first piezo element, and 9 indicates a second piezo element. The transparent solvent 10 is supplied from a transparent solvent tank (not shown) to be supplied to the first cavity 6 and first nozzle 2 via a first supply groove 12 from a first supply pipe 11.

The ink 13 is supplied from an ink tank (not shown) to be supplied to the second cavity 7 and second nozzle 3 via a second supply groove 15 from a second supply pipe 14. The first piezo element 8 and the second piezo element 9 are connected to a piezo element bracket 19. Pressure is applied to the first cavity 6 and second cavity 7 via a first oscillation panel 16 and a second oscillation panel 17. The numerals 20, 21, 22, and 23 designate flexible panels for applying a driving voltage to the first piezo element 8 and the second piezo element B9.

Figure 8A:
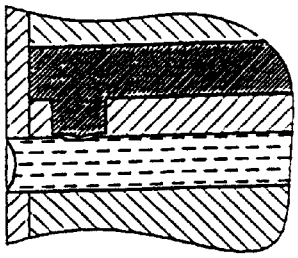
FIGS. 8A to 8J are schematic sectional views depicting the operation of the ink jet printer head in FIG. 1.

In the ink jet printer head, the discharge operation is performed in the manner shown in FIGS. 8A to 8J. More specifically, the transparent solvent 10 is supplied to the first nozzle 2 by the pressure of capillary action so that a meniscus having a crescent configuration is formed at the orifice with surface tension (FIG. 8A). During the waiting time before discharge, for example, 10[V] is applied to the first piezo element 8.

Figure 8B:
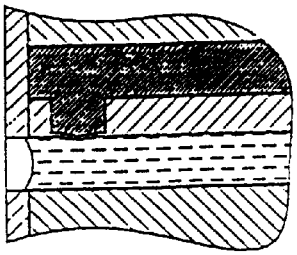

At discharge, the voltage applied to the first piezo element 10 is rendered 0[V]. This compresses the first piezo element 8, increases the volume of the first cavity 6 with the result that the internal pressure becomes negative, and the transparent solvent 10 is introduced into the first nozzle 2 (FIG. 8B). At the same time, or a little later, a driving voltage of, for example, 10[V] is applied to the second piezo element 9. An internal pressure is applied to the second cavity 7 and the second nozzle 3 via the second oscillation panel 17 with expansion of the second piezo element 9 in the longitudinal direction.

Figure 8C:
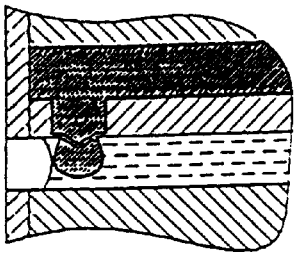

The ink 13 in the second nozzle 3 and the transparent solvent 10 in the first nozzle 2 are separated by the unidirectional valve 5 during the waiting time. The internal pressure presses and opens the unidirectional valve 5 and causes the ink 13 to be pushed out into the first nozzle 2 through the mixing hole 4 (FIG. 8C). The amount of ink 13 that is pushed out is controlled by either the voltage value of the driving voltage pulse applied to the second piezo element 9 or a pulse width.

Figure 8D:
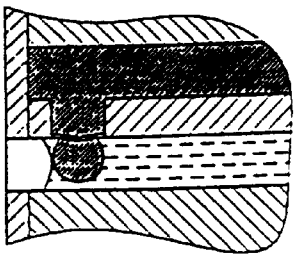
Figure 8E:
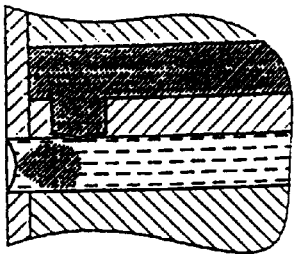

When the voltage pulse ceases to be applied to the second piezo element 9, the second piezo element 9 returns to the original size. At this time, the internal pressure of the second cavity 7 becomes negative, and the ink tends to be sucked back into the second nozzle 3. However, since the unidirectional valve 5 closes at this time, the ink that has been pushed out remains in the first nozzle 2 (FIG. 8D). The negative pressure in the first cavity 6 generated by the compression of the first piezo element 8 returns to the original state so that transparent solvent is instead resupplied to the first nozzle 2 (FIG. 8E).

Figure 8F:
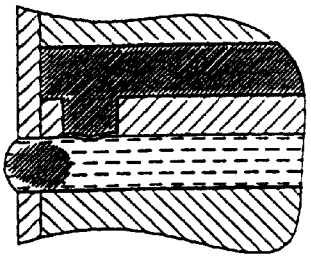
Figure 8G:
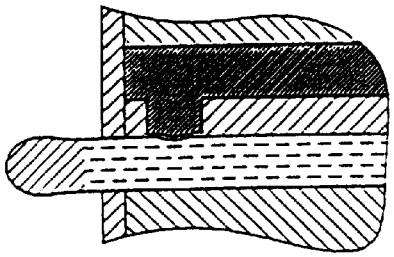
Figure 8H:
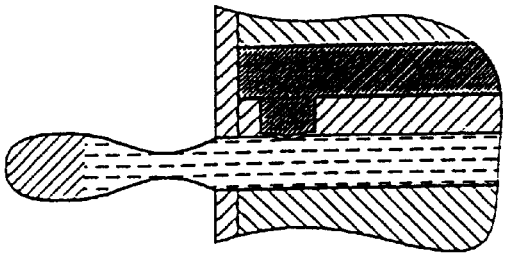

Next, 20[V] is applied as a drive signal to the first piezo element 8 with the result that an internal pressure is applied to the first cavity 6 and the first nozzle 2 via the first oscillation panel 16. The internal pressure integrates (mixes) the transparent solvent 10 with the pushed out ink 13 so that a liquid ink drop of a predetermined density is discharged from the orifice 1 (FIGS. 8F to 8H).

Figure 8I:
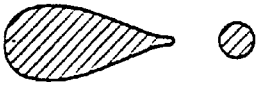
Figure 8I:
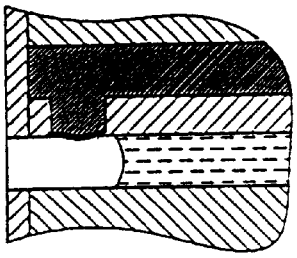
Figure 8J:
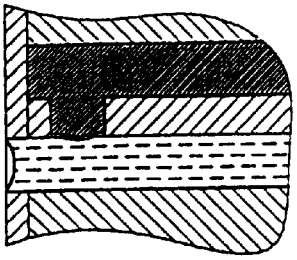

When the voltage applied to the first piezo element 8 is lowered to 10[V] after this, the internal pressure in the first cavity 6 and the first nozzle 2 becomes negative with the compression of the first piezo element 8, so that the transparent solvent 10 is introduced into the first nozzle 2 (FIG. 8I). The internal pressure of the first cavity 6 and the first nozzle 2 soon returns to the original state. The transparent solvent 10 is resupplied to the first nozzle 2 under the pressure of capillary action (FIG. 8J).

In this series of operations, the unidirectional valve 5 serves to prevent any unnecessary mixing between the ink 13 and the transparent solvent 10 during the waiting time, the and serves to prevent the reverse flow of the ink when the distortion of the second piezo element 9 returns to normal after the ink is pushed out. This valve 5 also serves to prevent the infiltration of the transparent solvent 10 into the second nozzle 3 via the mixing hole 4 with the discharge pressure at discharge time.

Figure 9A:
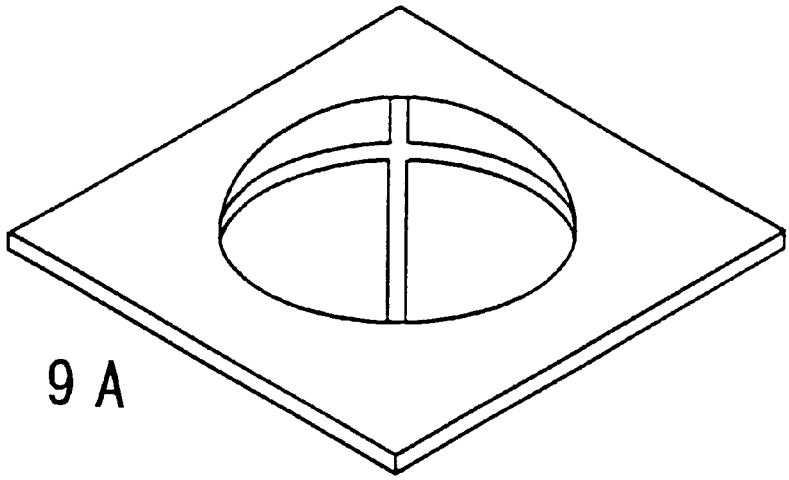
FIGS. 9A to 9C are schematic perspective views showing a construction of a unidirectional valve for use in the ink jet printer head in FIG. 1.
Figure 9B:
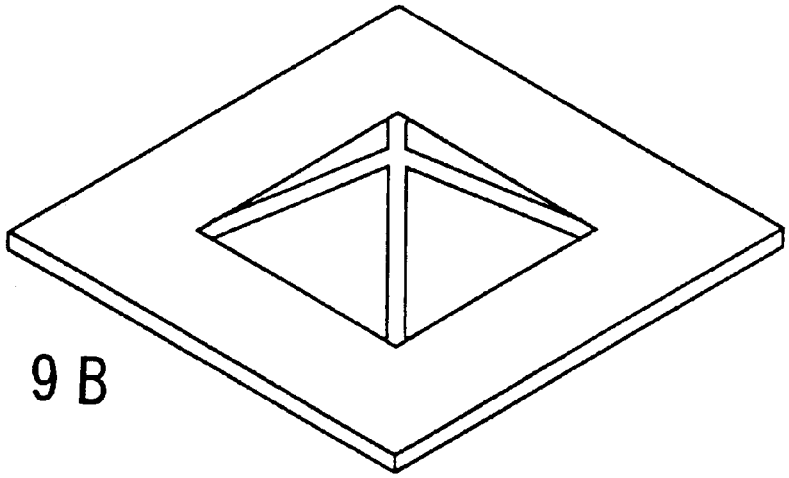
Figure 9C:
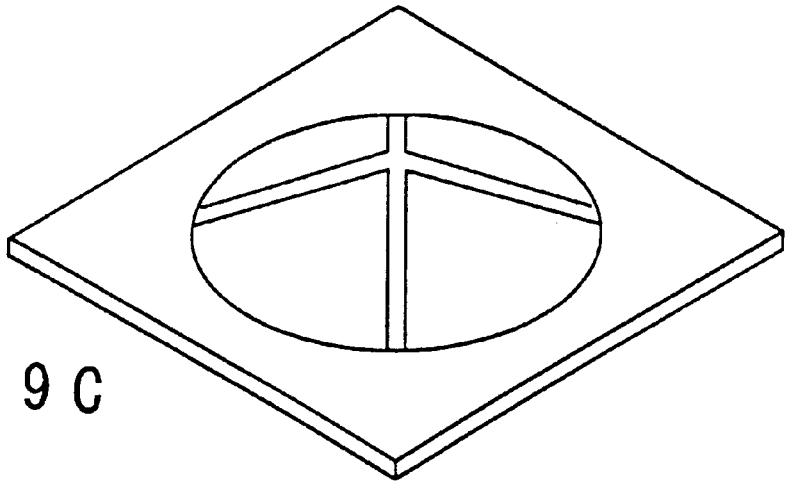

In this ink jet printer head, the unidirectional valve 5 is provided with a projecting section in a panel-like substrate as shown in FIGS. 9A to 9C. A radial slit is processed and formed on the projecting section. In addition, in the operation shown in FIGS. 8A to 8J, the voltage is applied to the first piezo element 8 during the waiting time, and the voltage is turned off when or before the ink is pushed out. Introducing the transparent solvent into the first nozzle 2 prevents the ink or the transparent solvent from being pushed out from the orifice 1 when the ink is pushed out.

Figure 10A:
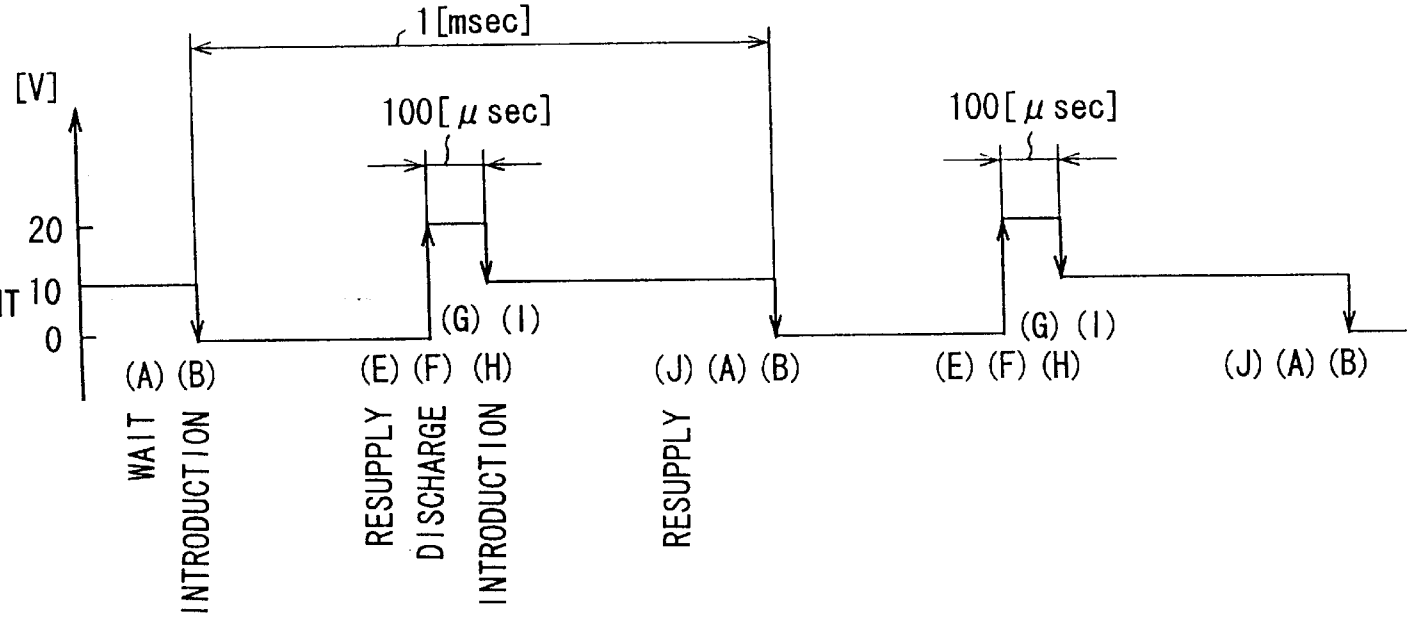
FIGS. 10A and 10B are timing charts depicting the driving voltage used in the ink jet printer head in FIG. 1.
Figure 10B:
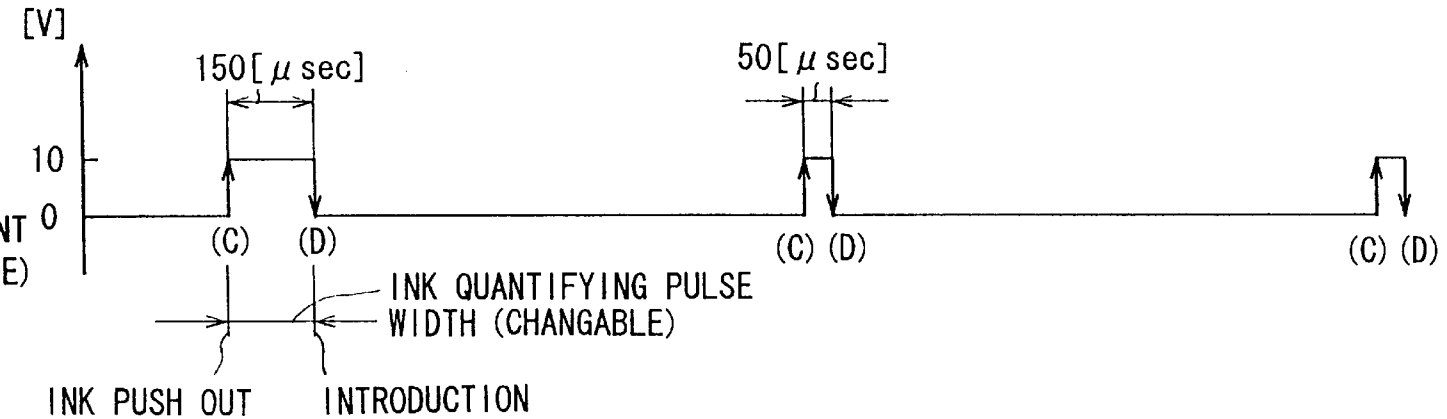

A signal voltage is applied to the first piezo element 8 and the first piezo element 9 at the timing shown in FIGS. 10A and 10B. In FIGS. 10A and 10B, the axis of the abscissa represents time, whereas the axis of the ordinate represents voltage. In the case of the embodiment, the discharge cycle is represented by 1 [msec] (a frequency of 1 [kHz]). During the cycle, the ink is quantified and mixed and the liquid ink drop is discharged. The time in FIGS. 8A to 8J is shown in the timing chart. It is required that the ink 13 pushed out in FIGS. 8C and 8D is contained in the liquid ink drop that is to be discharged and that the ink 13 not remain in the first nozzle 2.

The mixing ratio of the ink for preventing the ink from remaining in the first nozzle 2 in actuality depends on various conditions such as the discharge frequency and the like. In the ink jet printer head of the embodiment, the mixing ratio is experimentally set at 70[%] or less. Consequently, to obtain sufficient maximum density, it is required that the ink have a sufficient density. When the ink has a density of 70[%] in terms of the mixed weight percentage, the ink contains a dye so that the printing density is given a reflection density of 1.5, or, preferably, a reflection density of 2.0 or more.

Figure 11:
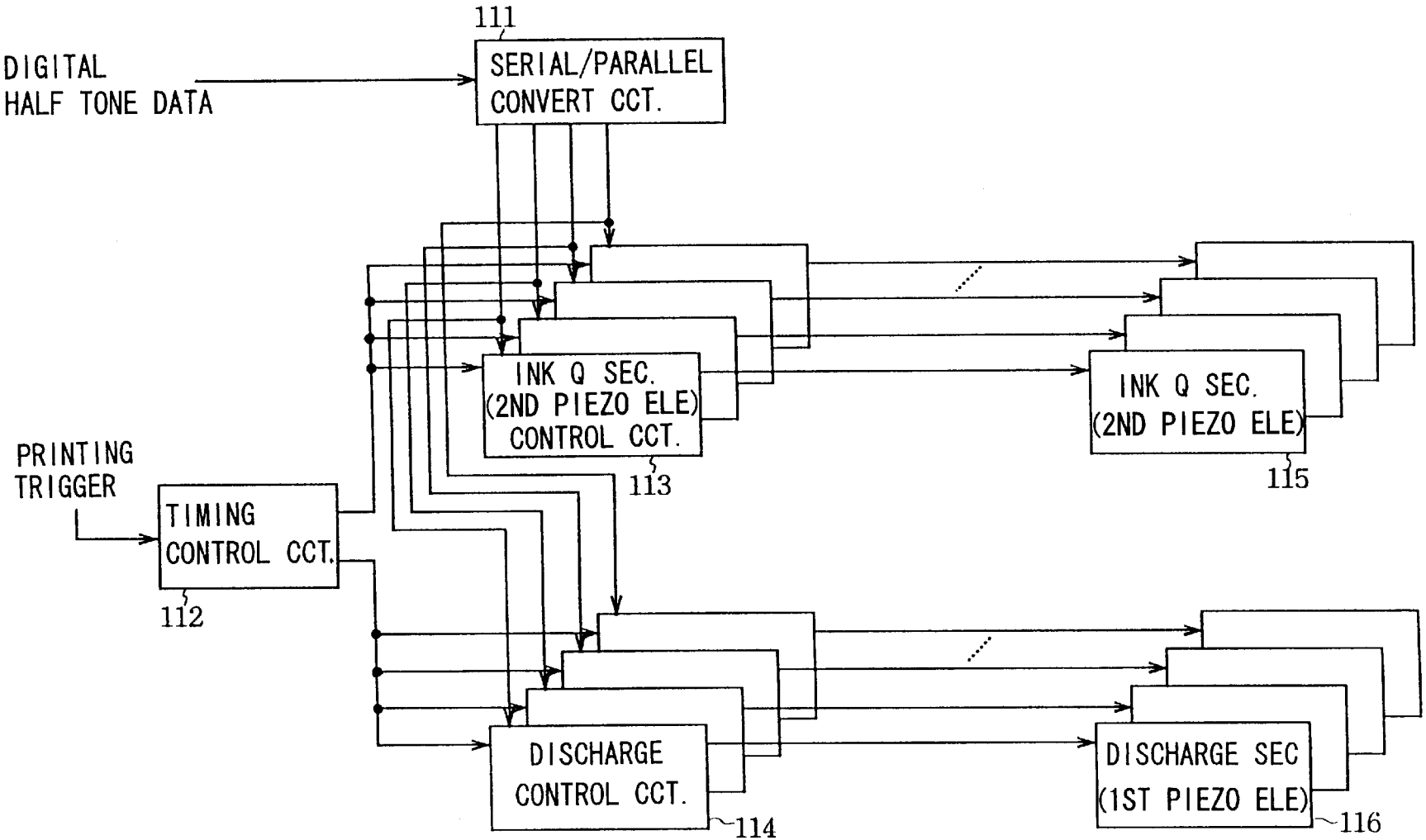
FIG. 11 is a block diagram showing a driving circuit of the ink jet printer head in FIG. 1.

The drive circuit of the ink jet printer head of this invention is constituted as shown in FIG. 11 so that digital half tone data is supplied from the other block. Then, the serial/parallel conversion circuit 111 sends the digital half tone data to each ink quantifying section (second piezo element) control circuit 113, and a discharge control circuit 114. The digital half tone data supplied from the serial/parallel conversion circuit 111 assumes a value less than a threshold value, and the ink is not quantified and discharged.

10[V] is applied to the first piezo element whereas 0[V] is applied to the second piezo element. At the time of printing, a printing trigger is output from other blocks. A timing control circuit 112 detects the printing trigger to output a control signal to the ink quantifying section and the discharge control signal to the ink quantifying section control circuit 113 and the discharge control circuit 114. Each signal is output at the aforementioned timing with respect to FIGS. 10A and 10B.

The timing control circuit 112 provides a timing at which the applied voltage to the first piezo element is changed in the order of 10[V] to 0[V] to 20[V] and to 10[V] so that the discharge control circuit 114 applies the aforementioned predetermined voltage to the discharge section (first piezo element) 116 in accordance with the aforementioned variation.

At the same time, the timing control circuit 112 provides a timing at which the applied voltage to the second piezo element is changed in the order of 0[V] to 10[V] and to 0[V] to the ink quantifying section control circuit 113 so that the ink quantifying section control circuit 113 applies the predetermined voltage to the ink quantifying section (second piezo element) 115. This causes the second piezo element 9 to push out a predetermined amount of ink to the first nozzle 2.

The main dimension of the ink jet printer head in this particular embodiment is set as follows: the orifice 1 has a pitch of 0.338 [mm] (75 [dpi]) and the first and second piezo elements 8, 9 have a size of 0.15×0.5×3 [mm]. In addition, the orifice 1 has a rectangular shape that is 20 [μm] on the side. The first nozzle 2 and the second nozzle 3 have a cross section configured into a rectangular shape of 20 [μm], and the round ink mixing hole is formed at 20 [μm].

Figure 12:
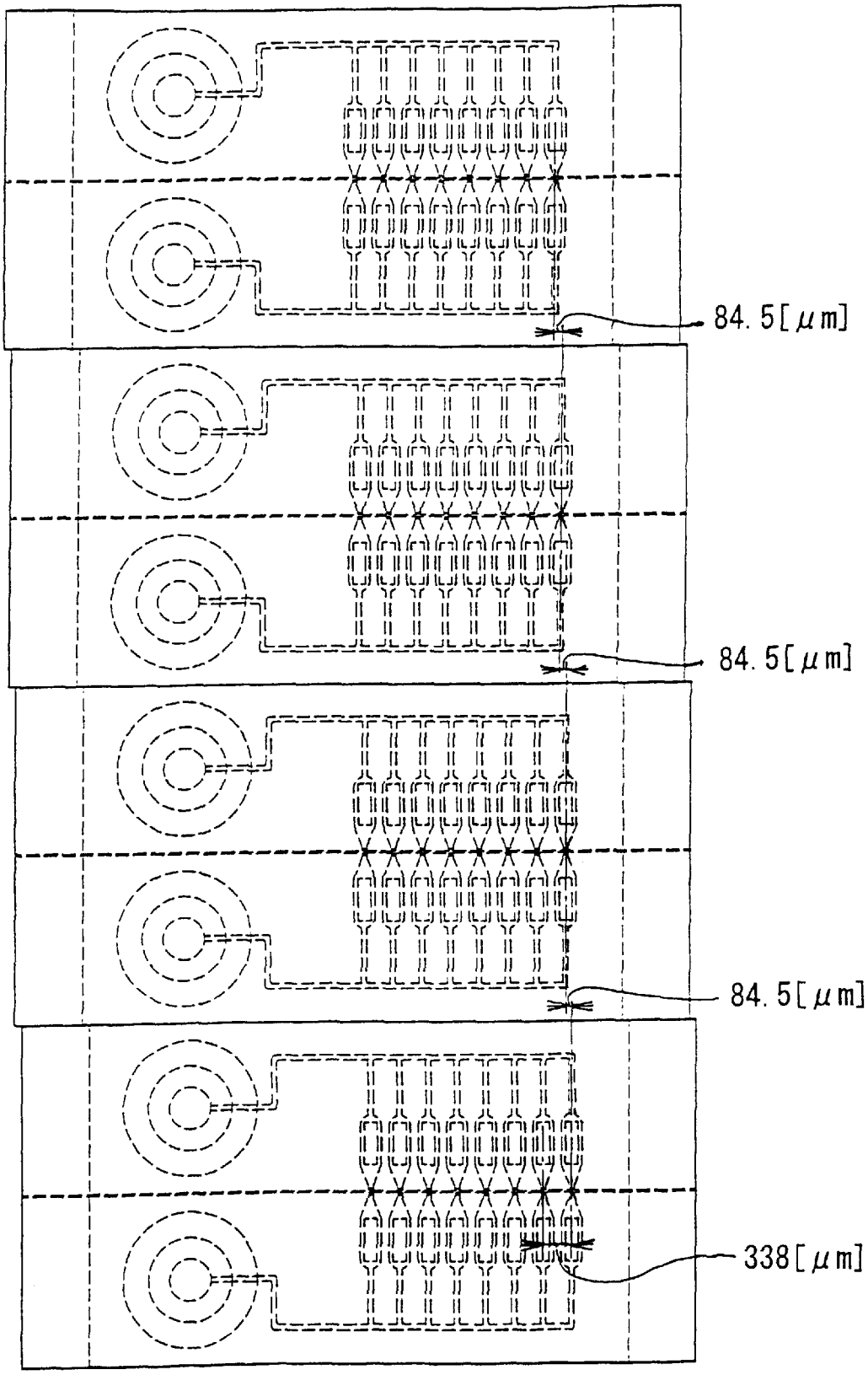
FIG. 12 is a plane view depicting a technique for narrowing a nozzle pitch using the ink jet printer head of FIG. 1.
Figure 13:
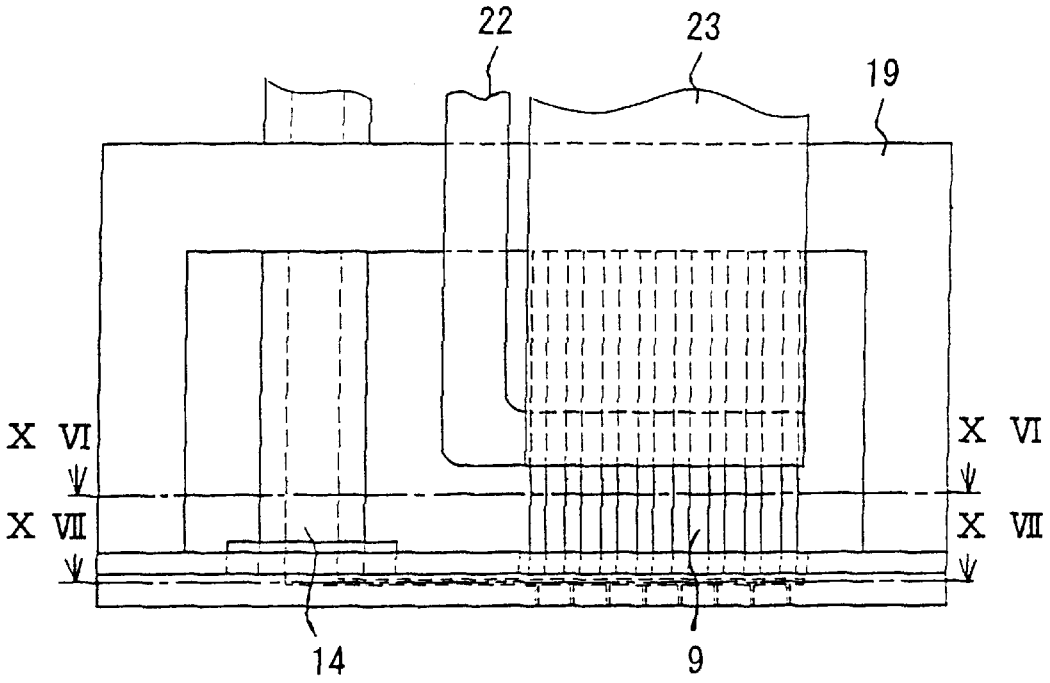
FIG. 13 is a top view showing the construction of the ink jet printer head according to the second embodiment of this invention as viewed from the printing surface.
Figure 14:
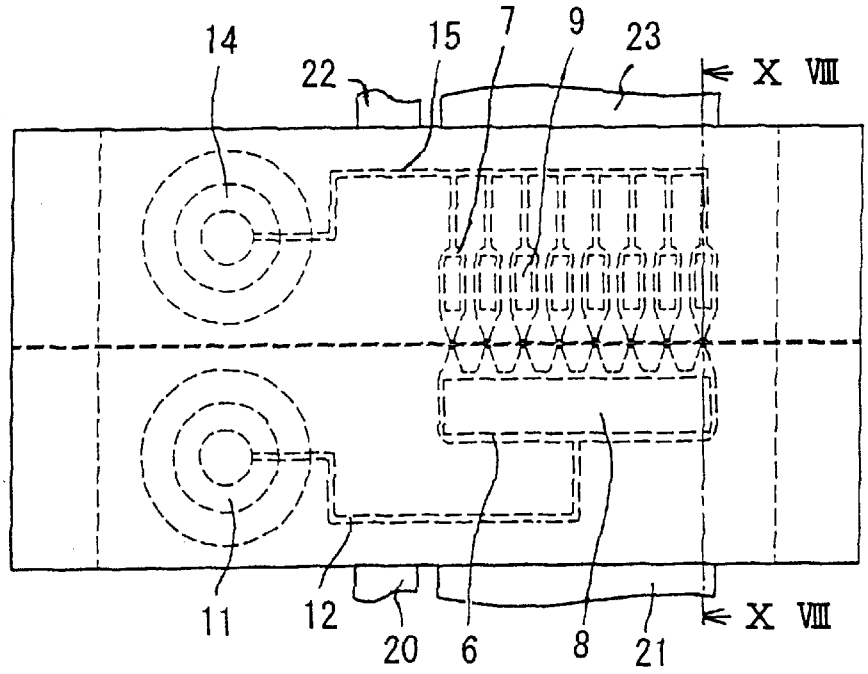
FIG. 14 is a front view showing the construction of the ink jet printer head in FIG. 13.
Figure 15:
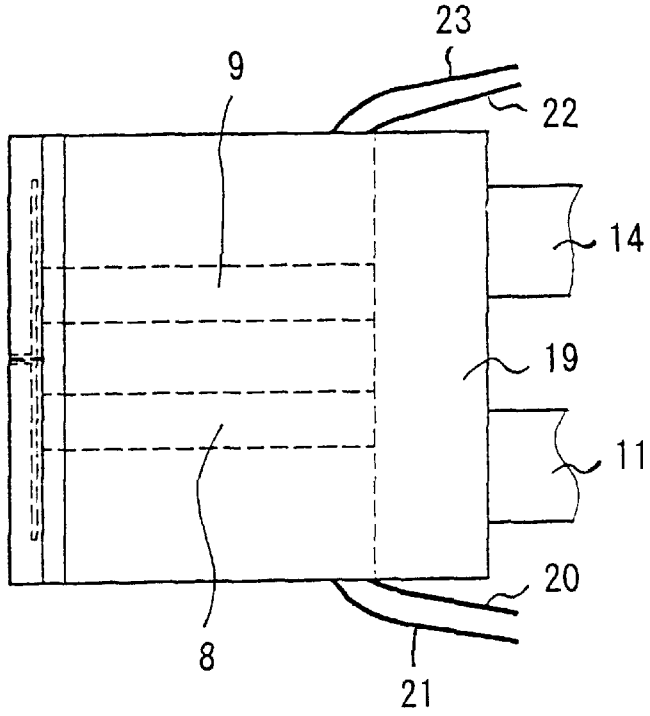
FIG. 15 is a right-side view showing the construction of the ink jet printer head in FIG. 13.
Figure 16:
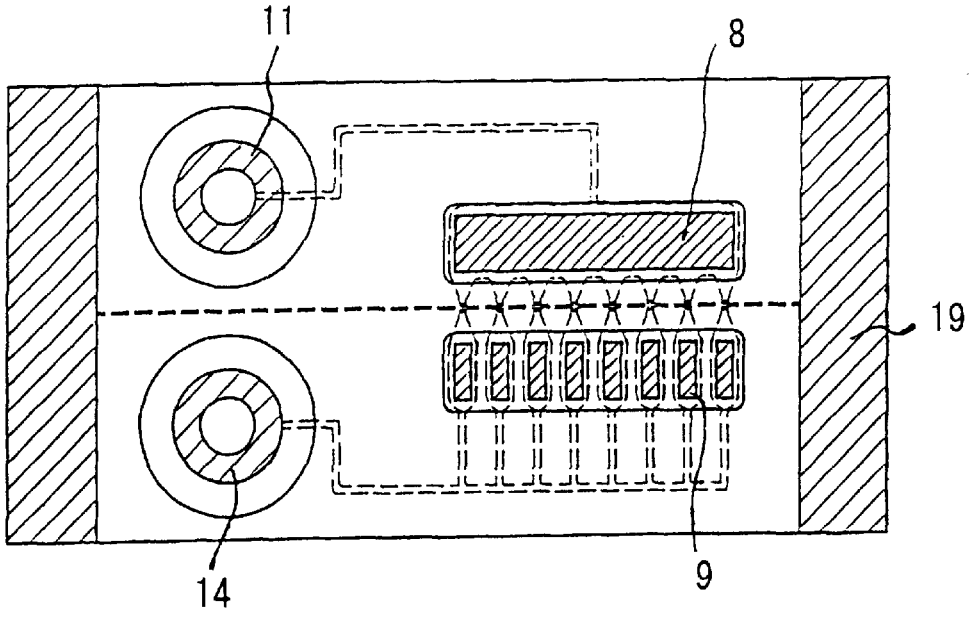
FIG. 16 is a sectional view showing the ink jet printer head in FIG. 13 taken along line XVI—XVI.
Figure 17:
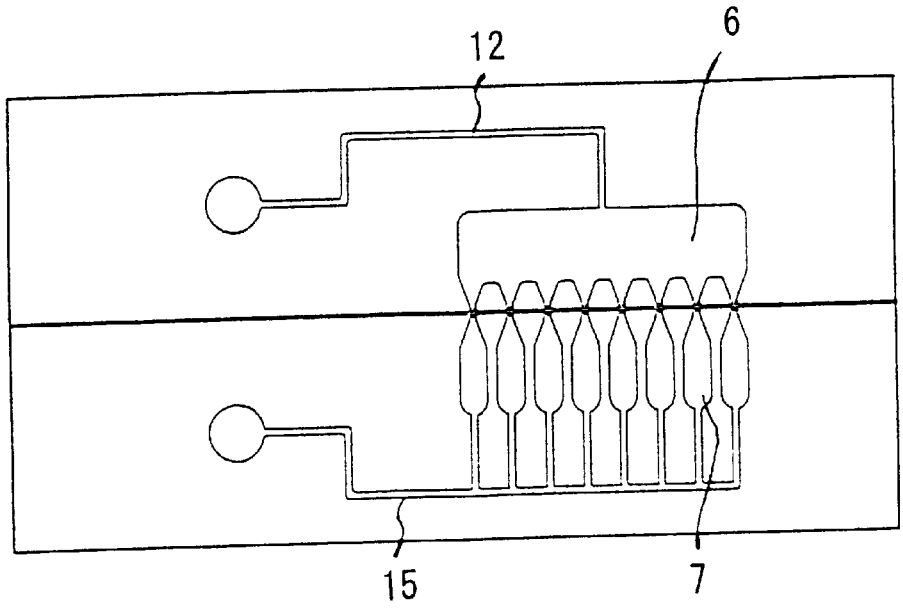
FIG. 17 is a sectional view showing the ink jet printer head in FIG. 13 taken along line XVII—XVII.
Figure 18:
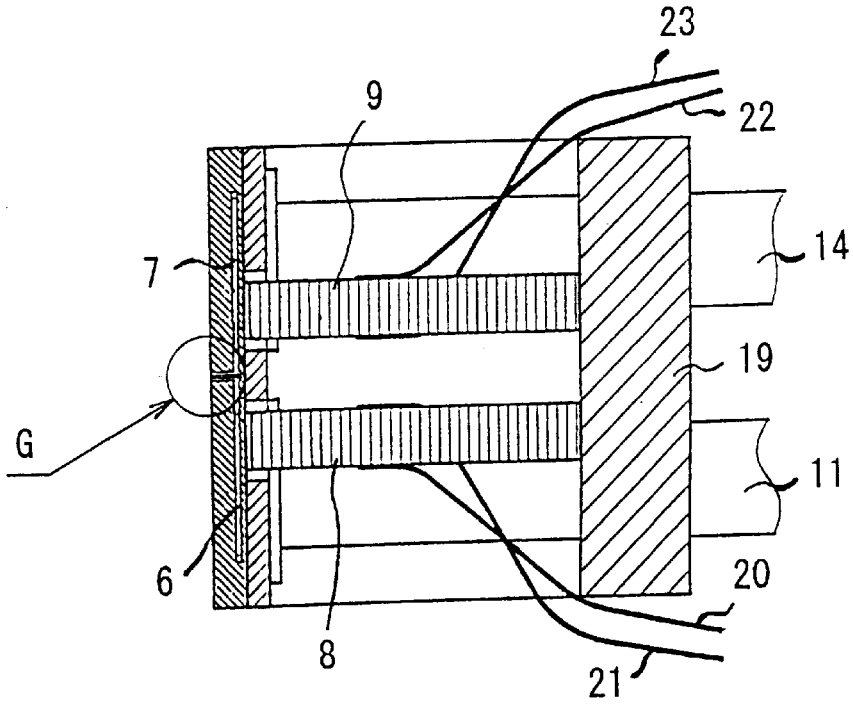
FIG. 18 is a sectional view showing the ink jet printer head in FIG. 14 taken along line XVIII—XVIII.

In accordance with the aforementioned embodiment, the ink jet printer head is composed of a single nozzle head. However, this invention is not only limited to this, but the ink jet printer head can be composed of a multiple-nozzle head corresponding to 8 nozzles or more, for example, 32 nozzles, 64 nozzles, 100 nozzles, or a full-line multiple head corresponding to the total width of the printing paper. Incidentally, the orifice pitch is set at 0.338 [mm], or 75 [dpi]. When the resolution is insufficient, as shown in FIG. 12, four heads are arranged by shifting the position of each head by one fourth pitch or 84.5 [μm] so that a resolution of 300 [dpi] is obtained. In such a case, the nozzle number is set to 32 nozzles.

(1-2) The second embodiment of ink jet printer head

Here, with respect to a method for mixing the ink with the transparent solvent, the discharge of the ink can be eliminated on demand. In the aforementioned the first embodiment, when the digital half tone data assumes a value less than a predetermined threshold value, the ink is neither quantified nor discharged. In other words, it has been constituted so that no characters are printed. However, it is possible to discharge the ink at all times. In other words, it is possible to print characters at all times.

More specifically, in the case of the ink jet printer head, as shown in FIGS. 13 to 18 in which like numerals designate sections corresponding in FIGS. 1 to 6, only the piezo element for quantifying and mixing the ink is constituted in a multiple construction so that the discharge side is constituted of one piezo element so that the ink is discharged from a plurality of nozzles at the same time. This simplifies the construction of the circuit and simplifies the head construction itself so that the number of sections can be reduced.

Figure 19:
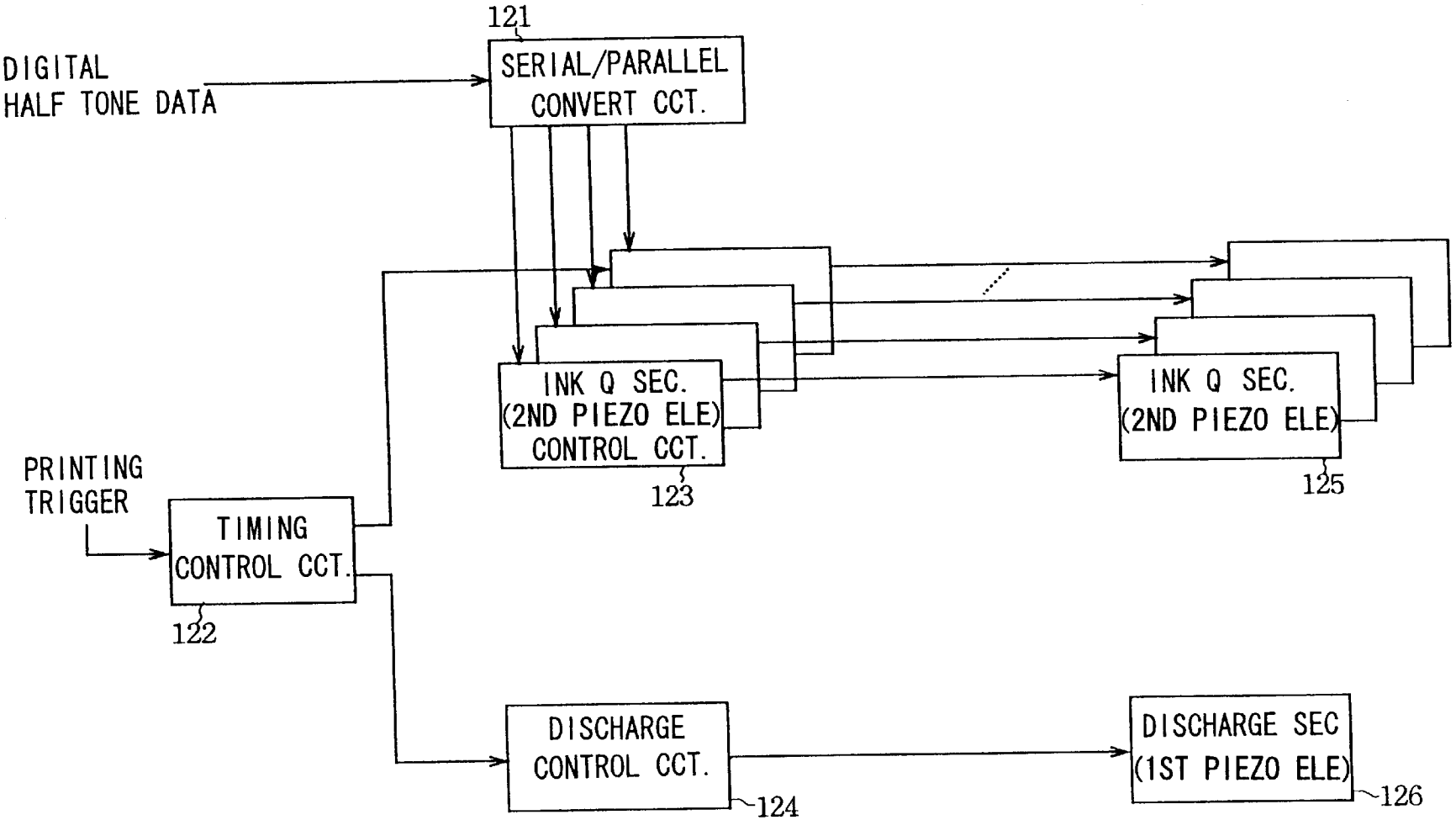
FIG. 19 is a block diagram showing a driving circuit of the ink jet printer head of FIG. 13.

In this case, the transparent solvent is printed to express white. This can simplify the discharge control circuit section of driving circuit of the head as shown in FIG. 19. In this case, it can simplify the discharge control circuit 124. Thus, it is not necessary to connect the serial/parallel conversion circuit 121 to the discharge control circuit 124. It is also possible to make the piezo element 126 operate uniformly in ink discharge.

(1-3) Method for preparing the ink jet printer head

Here, as a method for preparing an ink jet printer head in this particular embodiment, FIGS. 20, 21A to 21F, 22A and 22B, and 23A and 23B show the fabrication and assembly processes. For simplification, the ink jet printer is described as a head having a single nozzle head. At the outset, in the fabrication of the head section, a groove is formed at a width of 30 [μm], and a depth of 30 [μm] on the end face of a glass 301 having a thickness of 0.3 [mm] by dicing. In addition, a panel 302 is prepared from stainless steel having a thickness of 50 [μm] by etch processing a cavity, a supply groove, and a supply hole. In the same manner, a supply hole is etch processed to prepare a panel 303 on stainless steel having a thickness of 50 [μm]. These panels 302 and 303 are laminated together with an epoxy adhesive agent to form a component 304.

Figures 21A, 21B, 21C:
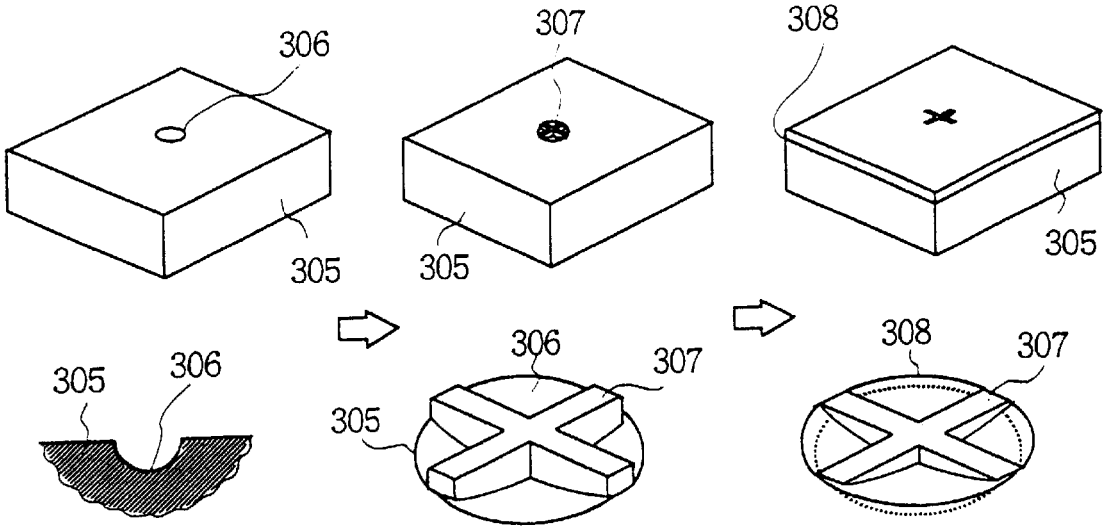
FIGS. 21A to 21F are schematic perspective views showing the steps involved in fabricating the ink jet printer head of this invention.

FIGS. 21A to 21F show the preparation of the unidirectional valve section. The unidirectional valve is prepared using a photoelectroforming technique. A crater-like hollow 306 having a diameter of 20 [μm], a depth of 5 [μm] is formed on the stainless steel panel 305 which serves as a matrix (FIG. 21A). Subsequently, the panel matrix is subjected to pretreatment (peel-off film treatment), and a photoresist is coated on it, exposed, and developed. As an original panel to be used for exposure, a pattern is used which has a cross-like configuration. On the hollow 306, which has been prepared onto the matrix 305 in advance, a cross-like resist pattern 307 having a width of 3 [μm] is allowed to remain (FIG. 21B).

Figures 21D, 21E, 21F:
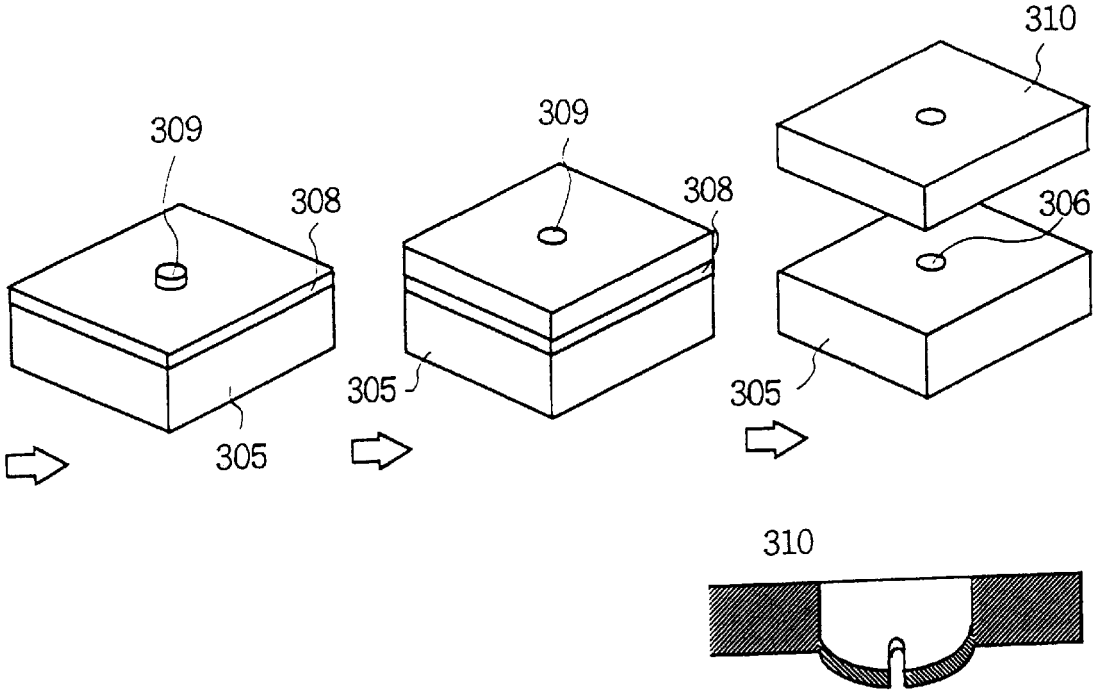

Next, nickel is plated (308) onto the matrix 305 on which a resist pattern 307 is formed (FIG. 21C). The nickel plating has a thickness of 1 to 10 [μm], or, preferably, a thickness of 3 to 5 [μm]. In this state, the photoresist is coated again, exposed, and developed. At this time, the original panel for exposure uses a pattern such as that shown in the FIG. 21C. A column-like resist 309 is allowed to remain on the cross-like pattern (FIG. 21D). Subsequently, the nickel plating has a thickness of 5 to 30 [μm], or, preferably, a thickness of 10 to 20 [μm] (FIG. 21E). After plating, the resist is removed, and the plated nickel film is peeled off the matrix to obtain a thin nickel panel 310 having a cross slit in the hemispherical recessed section shown in FIG. 21E (FIG. 21F).

Figure 20:
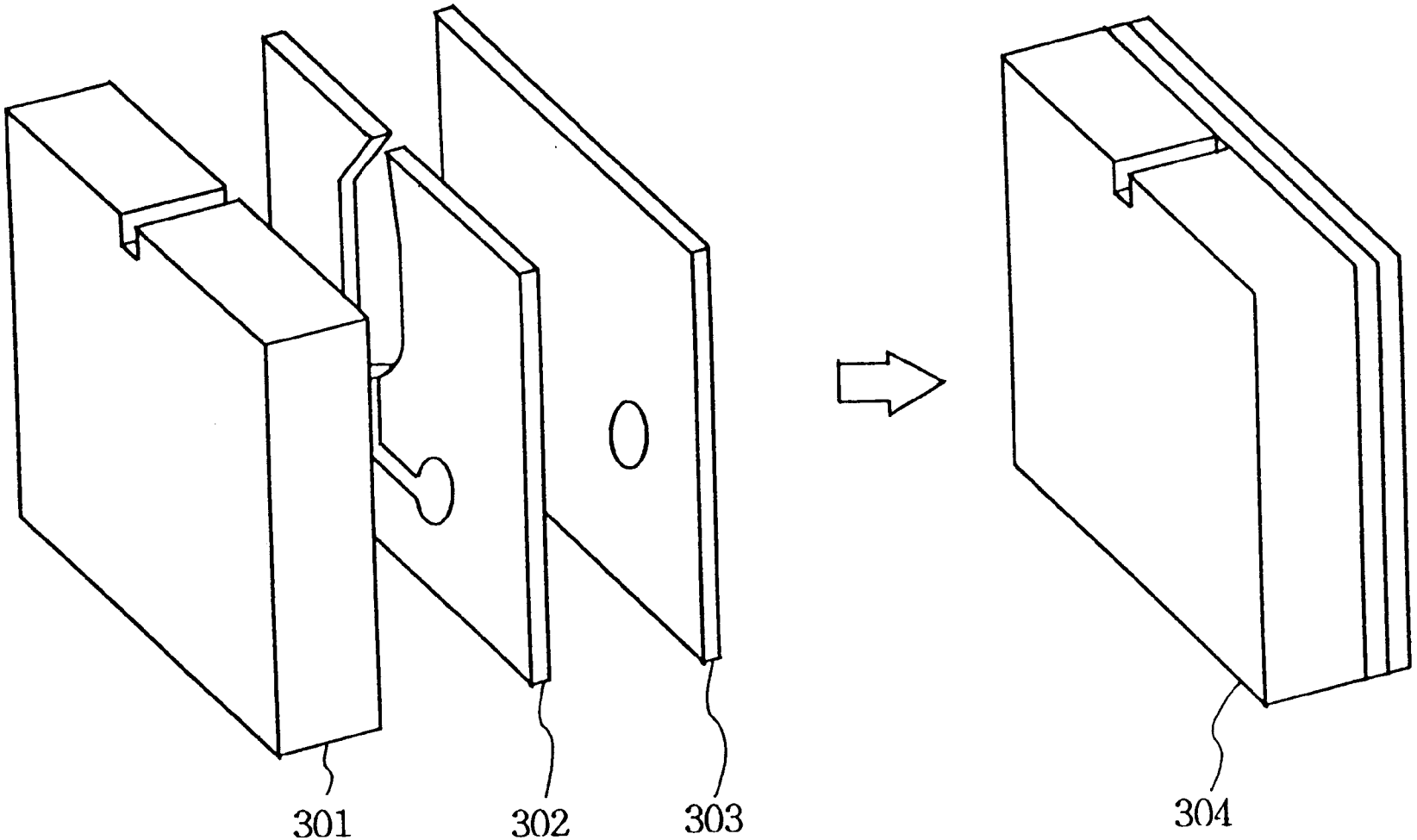
FIG. 20 is an exploded schematic perspective view explaining the step according to fabricating the ink jet printer head of the first embodiment.

Next, the head section component 304 processed in FIG. 20 and the thin nickel panel 310 of the unidirectional valve section are assembled as shown in FIGS. 22A and 22B. In other words, at the outset, a stainless steel panel 311 with a thickness of 0.3 [mm] is prepared in such a manner that the open section thereof as shown in FIGS. 22A and 22B is formed by etching or wire cutting. As described in conjunction with FIGS. 20, and 21A to 21F, the prepared component 304 and a component 304' which is a mirror image of the component 304 (the component 304' may be of the same shape as the component 304), the thin nickel panel 310, and the stainless steel panel 311 are assembled and bonded together as shown in FIGS. 20, and 21A to 21F. After the components 304 and 304', the thin nickel panel 310, and the stainless steel panel 311 are bonded, surfaces C shown in FIG. 22B are ground and smoothed. In this process, the dimension of each section and grinding cost are estimated in advance so that the distance from the center of the unidirectional valve 5 to the grinding surface becomes 30 to 40 [$\mu$m].

Figure 23A:
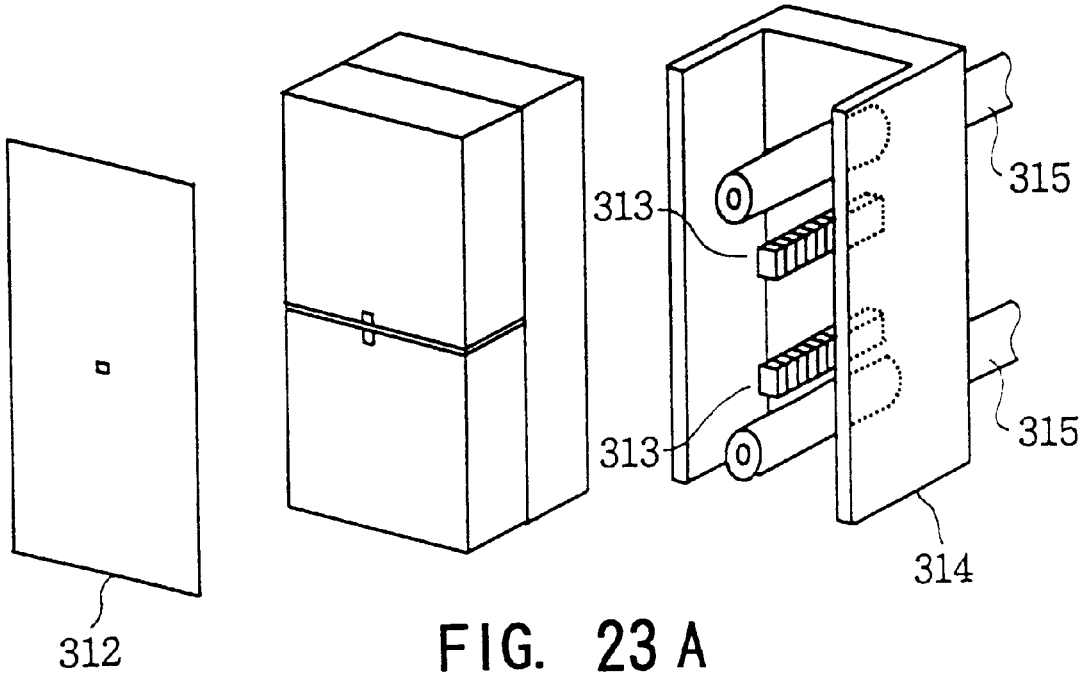
FIGS. 23A and 23B are schematic perspective views showing constructional features of the ink jet printer head of this invention.
Figure 23B:
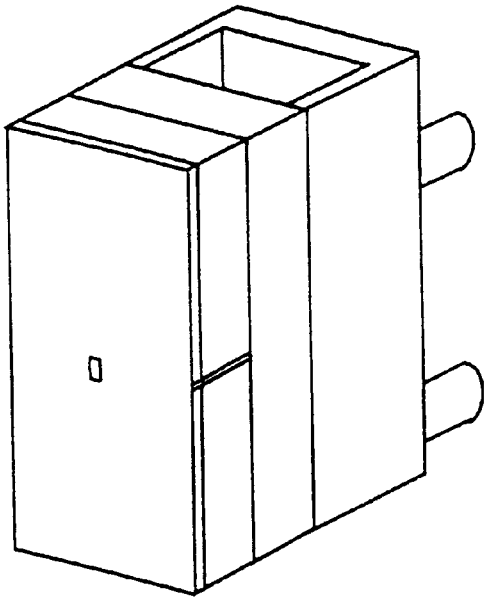

Lastly, as shown in FIGS. 23A and 23B, the orifice panel 312, the piezo element 313, and the piezo element bracket block 314 are assembled and bonded, thereby completing the ink jet printer head in this manner. Incidentally, a laminate type piezo element is used as the piezo element, in which a laminated piezo element is cut in a leaflet-like configuration.

(1-4) Advantage of the first and second embodiments

In the aforementioned construction, the ink and the transparent solvent are quantified and mixed in accordance with the density data for each of the given pixels. The liquid ink drop having the density based on the density data for each of the given pixels is deposited onto the recording medium by depositing the mixed ink liquid onto the recording medium to represent, in a simple construction, a half tone with certitude in accordance with the density data.

Furthermore, the ink jet printer head having the aforementioned construction can record a high gradation representation for one pixel, thereby enabling a high-quality continuous gradation recording and a density scale representation with a printing density for one dot unit that cannot be represented in the prior art. In addition, a unidirectional valve having a slit processed on the panel can prevent the unnecessary natural mixing of the ink and the transparent solvent, with the result that the supply amount of the ink and the transparent solvent can be quantified and controlled very accurately, thereby enabling a high-quality continuous gradation recording.

Furthermore, the aforementioned construction allows the spillover of the ink and the transparent solvent from the orifice by introducing the transparent solvent and the ink before pushing the ink out or the transparent solvent, thereby, the amount of ink and the transparent solvent supplied can be quantified and controlled very accurately. Still furthermore, the aforementioned construction enables the certain prevention of the reverse flow of the ink by including a unidirectional valve in a configuration having a radial slit provided on the recessed section, and preparing a very precise unidirectional valve with the photoelectroforming method.

Figure 24:
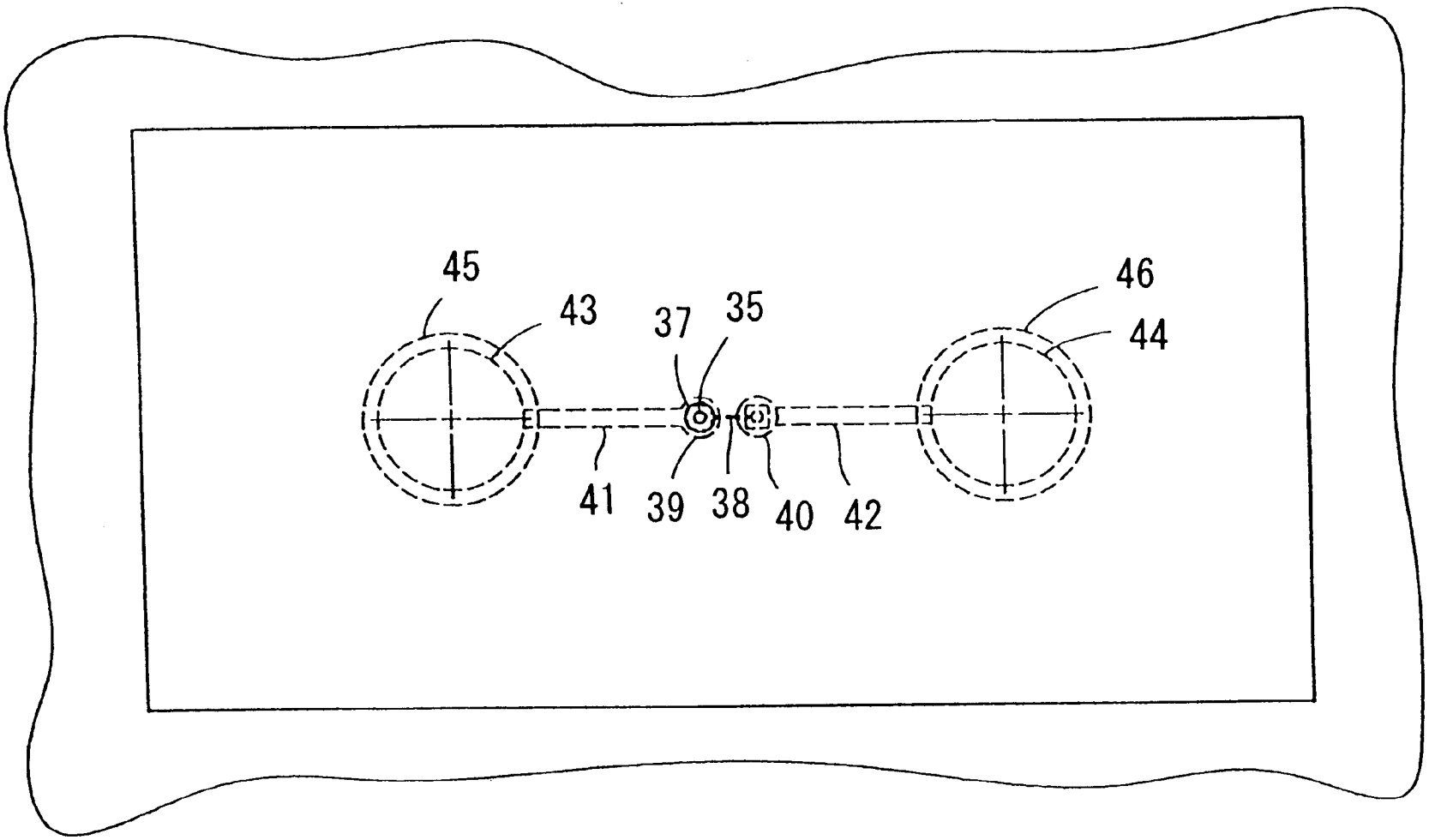
FIG. 24 is a front view showing the construction of the ink jet printer head according to the third embodiment of this invention as viewed from a printing surface.
Figure 25:
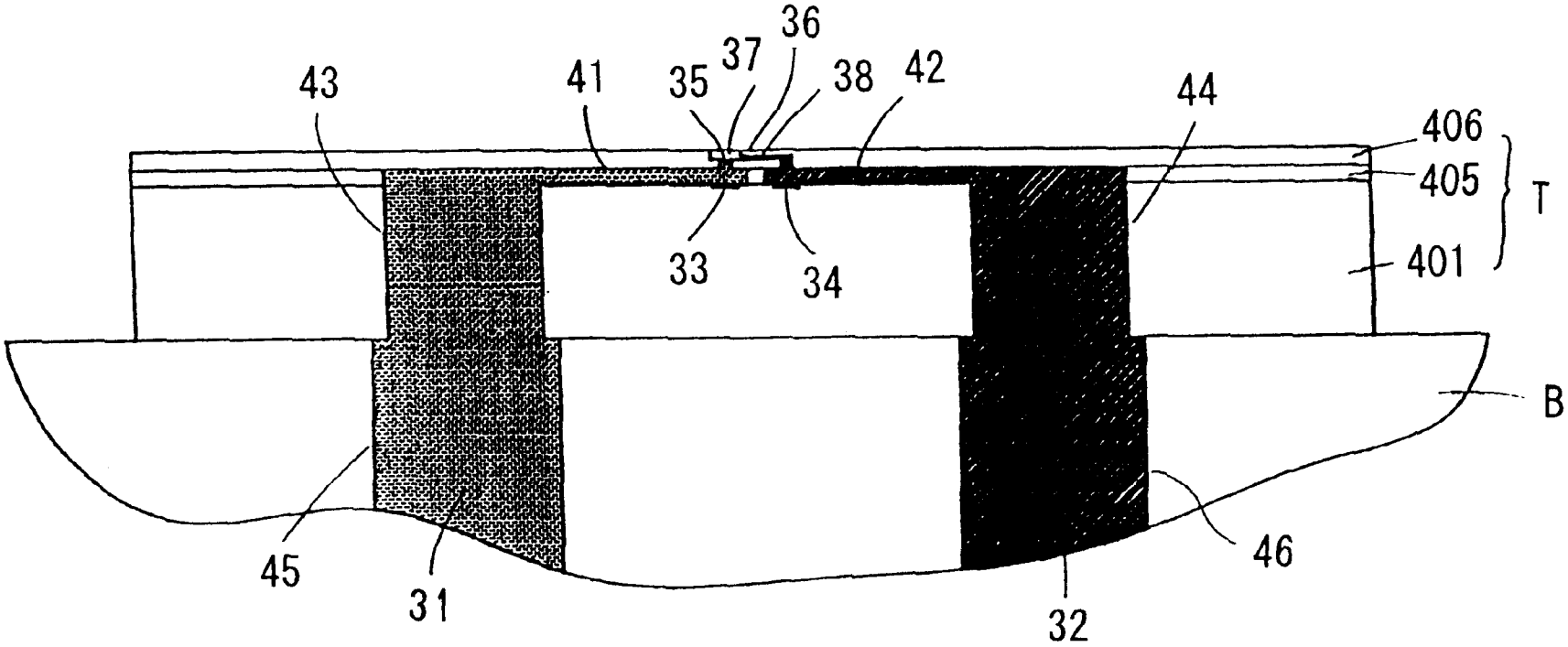
FIG. 25 is a right-side view showing the construction of the ink jet printer head of FIG. 24.
Figure 26:
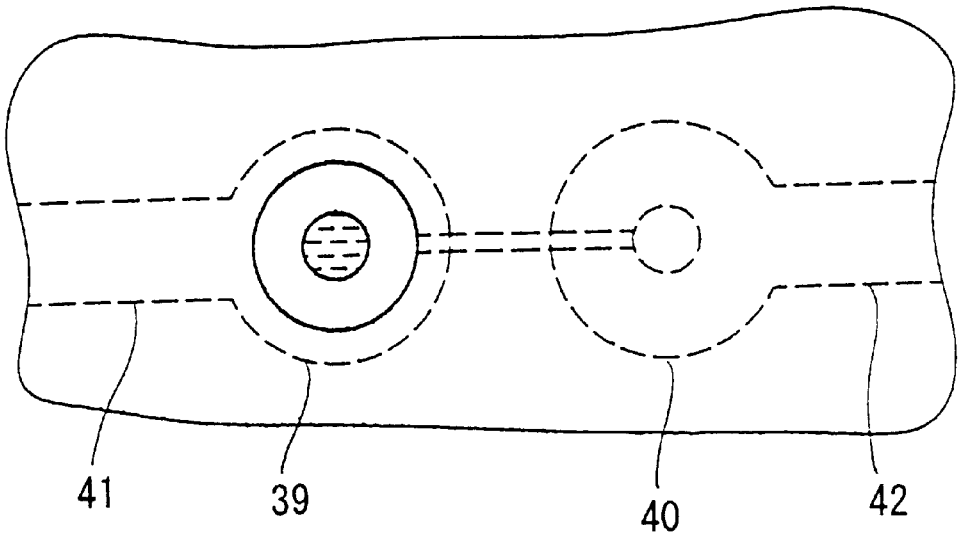
FIG. 26 is an enlarged front view showing a nozzle portion of the ink jet printer head of FIG. 24.
Figure 27:
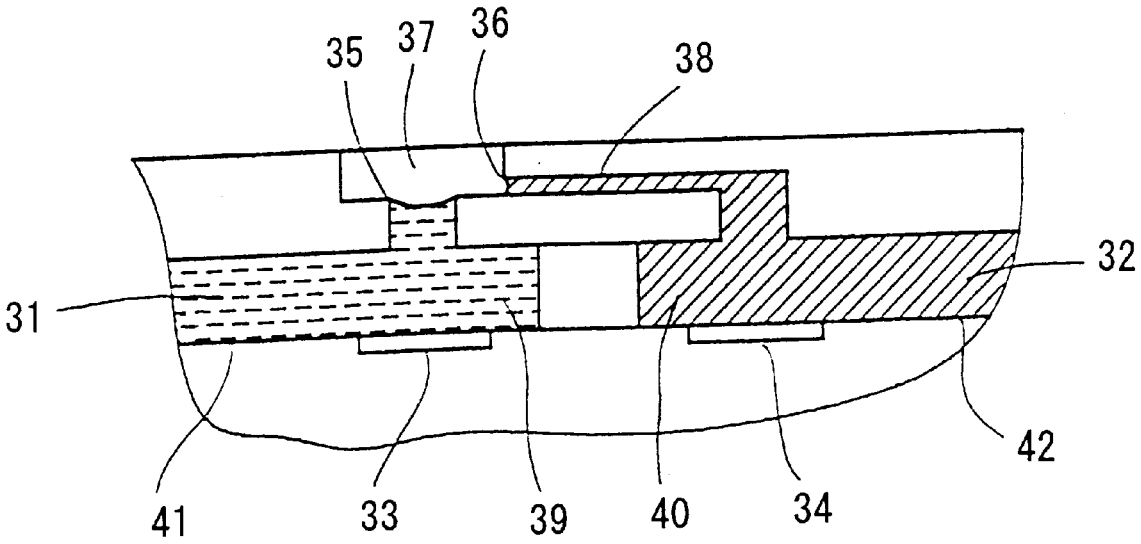
FIG. 27 is an enlarged sectional view showing a nozzle portion of the ink jet printer head of FIG. 25.

(2) Ink Jet Printer Head using Heating Element (2-1) The third embodiment of ink jet printer head FIGS. 24 and 25 show the main portion of the ink jet printer head according to the third embodiment of this invention, and FIGS. 26 and 27 show the enlarged discharge port of the ink jet printer head. In FIGS. 24 and 25, a head tip T adheres to a base B, the transparent solvent 31 is supplied from a transparent solvent puddle (source) 45 in the base B to a first connection groove 43 of the head tip T, and the ink 32 is supplied from an ink puddle (source) 46 in the base B to a second connection groove 42 of the head tip T. In the head tip T, the transparent solvent 31 is supplied to a first cavity 39 through the first connection groove 43 and a first supply groove 41 and is kept in the cavity by capillary attraction. In a first orifice 35, the transparent solvent 31 forms meniscus M1 having a crescent configuration.

The ink 32 is supplied to a mixing groove 38 through a second connection groove 44 and a second supply groove 42, and a second cavity 40, and is kept in the mixing groove by capillary attraction. In a second orifice 36, the ink 32 forms meniscus M2. A first heating element 33 and a second heating element 34 are so arranged that it is close to the first cavity 39 and the second cavity 40 respectively as shown in the figure. The transparent solvent 31 and the ink 32 having various construction can be used. In this embodiment, the transparent solvent 31 in which interface activator is added to pure water and is used with an aqueous ink 32.

Figure 28A:
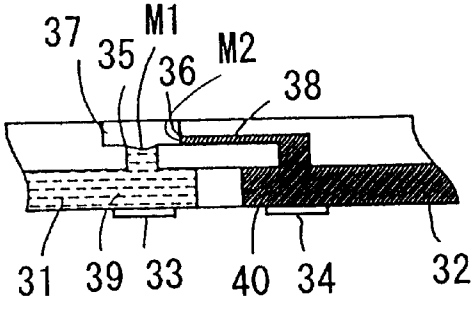
FIGS. 28A to 28G are schematic sectional views depicting the operation of the ink jet printer head of FIG. 24.
Figure 28B:
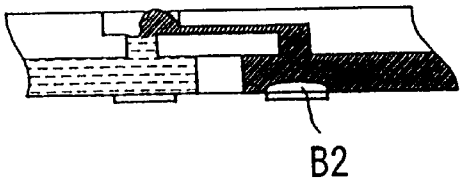

FIGS. 28A to 28G show the discharge operation of the ink jet printer head. The transparent solvent 31 is supplied to the first cavity 39 by capillary attraction, and forms meniscus M1 at the orifice 35 by surface tension. The ink 32 is supplied to the mixing channel 38 through the second cavity 40 by capillary attraction, and forms meniscus M2 at the second orifice 36 (FIG. 28A). The voltage pulse is supplied to the second heating element 34, so that the ink 32 film-boils and bubbles B2 is generated on the heating element 34 to raise internal pressure of the second cavity 40. Thereby, the ink 32 is pushed out from the second orifice 36 to the mixing portion or chamber 37 (FIG. 28B). The amount of the ink 32 pushed out is controlled by the voltage value of driving voltage pulse or pulse width which is supplied to the second heating element 34.

Figure 28C:
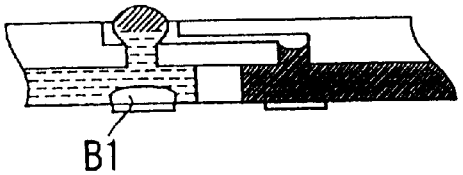

Then, a voltage pulse is supplied to the first heating element 33 and bubbles B1 is generated to raise internal pressure of the first cavity 39. Thereby, the transparent solvent 31 starts to jet out of the orifice 35, and the ink 32, which has been pushed out to the mixing portion 37, is united to the transparent solvent 31. At this time, or before this, the voltage pulse to the heating element 34 is turned off, bubbles B2 immediately disappears, and the internal pressure of the second cavity 40 drops. Therefore, the transparent solvent 31 and the ink 32 are separated near the second orifice 36, and the ink 32 is introduced toward the second cavity 40 (FIG. 28C).

Figure 28D:
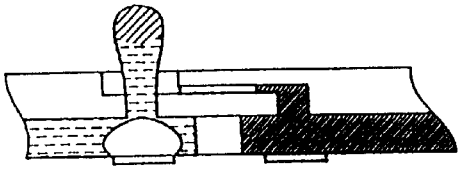
Figure 28E:
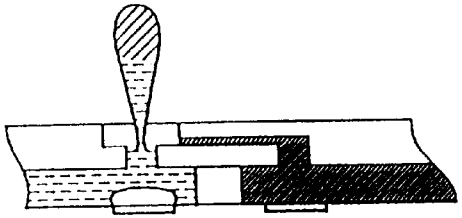
Figure 28F:
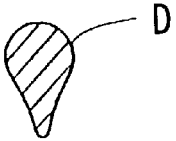
Figure 28F:
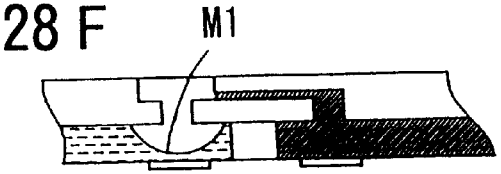
Figure 28G:
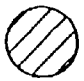
Figure 28G:
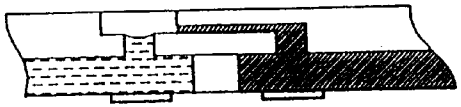

In FIG. 28D, the transparent solvent 31 in which the ink 32 jetted out of the first orifice 35 is mixed further grows as a column of liquid. The ink 32 begins to be supplied to the second cavity 40 and the mixing groove 38 again. In FIG. 28E, the voltage pulse to the heating element 33 is turned off, the bubbles B1 starts to shrink, and the transparent solvent 31 is introduced toward the cavity 39, so as to construct the narrow of the column of liquid. The ink 32 is supplied to the mixing channel 38 again. In FIG. 28F, the column of liquid is pulled out and separates into a drop D of mixed liquid, consisting of independent ink and transparent solvent, and the satellite S thereof to jet toward the recording medium direction. The meniscus M1 of the transparent 31 backs into the first cavity 39. In FIG. 28G, the transparent solvent 31 is supplied to the first cavity 39 again and returns to the state of the early stage.

A chain of the above operation is one of various method, and the timing or the state of each operation, such as a column shape of liquid, re-supplying operation, and absence of a drop of satellite liquid, are changed depending on the construction element such as the size of orifice, the physical element such as viscosity of ink 32 or transparent solvent 31 and surface tension, and the operation condition such as discharge frequency. The ink density of the drop D of mixed liquid, as shown in FIG. 28B, is determined by the amount of ink 32 pushed out of the second orifice 36, and is controlled by the amplification or the pulse width of the driving voltage pulse supplied to the heating element 34 as described above. When the amplification or the pulse width is enlarged, the amount of ink 32 is increased, and when it is diminished, the amount of ink 32 is decreased. The changeable range of the amplification and pulse width is set to the optimum value. The aperture area of the second orifice 36 is less than the aperture area of the first orifice 35, preferably, less than a half area of the first orifice 35. Thus, the ink 32 can be quantified with higher accuracy.

Figure 29A:
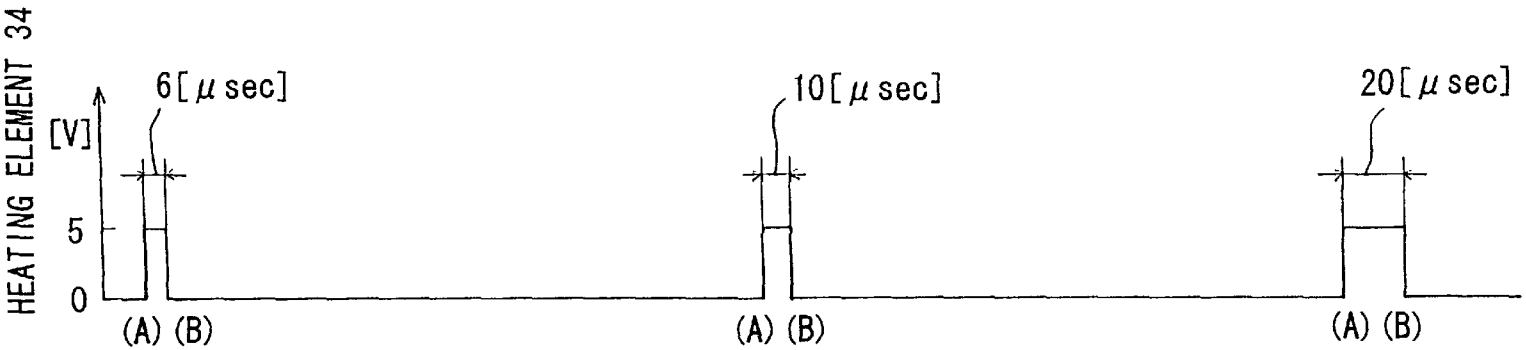
FIGS. 29A and 29B are timing charts explaining the driving voltage of the ink jet printer head of FIG. 24.
Figure 29B:
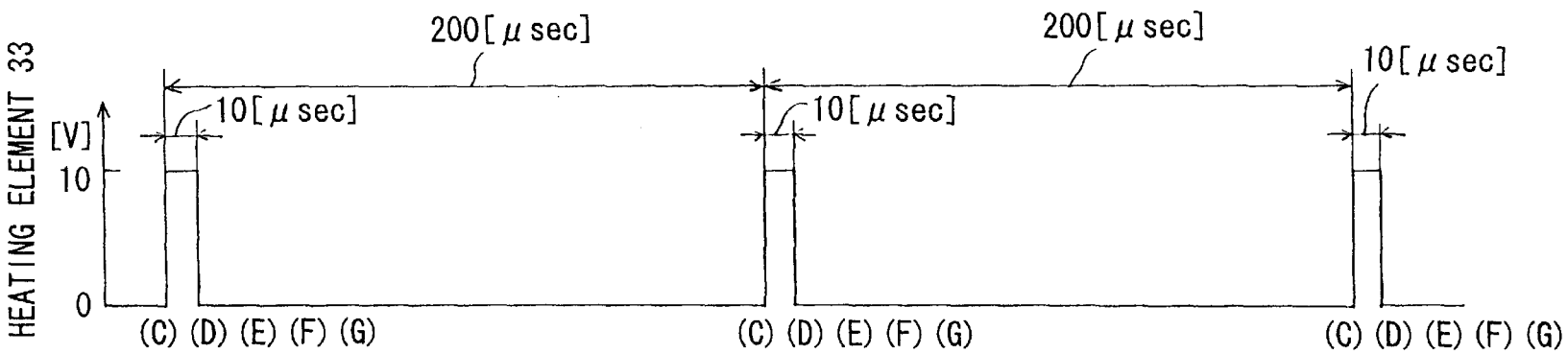

FIGS. 29A and 29B show the timing of the signal voltage to be supplied to the first heating element 33 and the second heating element 34, and the axis of abscissas indicates time and the axis of ordinates indicates voltage. In this embodiment, during the discharge cycle which is 200 [Usec] (frequency is 5 [kHz]), the ink 32 is quantified and mixed, and a drop of ink is discharged. Respective points in time of FIGS. 28A to 28G are shown in the timing chart. The discharge cycle, that is, the cycle for applying the driving voltage to the heating element 33 is fixed to 200 [usec], and the timing to push the ink 32, that is, the timing for turning on the driving voltage pulse to be added to the second heating element 34 is advanced or is delayed (the timing for turning off is fixed) to change the pulse width.

It is necessary that all of the ink 32 which has been pushed in FIG. 28B is included in a drop of discharged ink and does not remain in the first nozzle 2. The mixing ratio of ink 32 that the ink 32 does not remain in the first nozzle 2 is experimentally less than 50[%] in mixed weight percentage, which is depending on the condition such as discharge frequency, in the ink jet printer head of this embodiment. Therefore, because it is needed that the ink 32 have enough density to obtain the enough maximum density, when the ink 32 has the mixing weight percentage, 50[%], the ink 32 is arranged to contain coloring (dye or pigments), so that the printing density can obtain 1.5 reflection density, preferably, more than 2 reflection density. In this embodiment, an aqueous ink is used as the ink 32 and a mixture of pure water and interface activator is used as a transparent solvent 31. However, this invention can also use an oil-based ink and an oil-based solvent.

Figure 30:
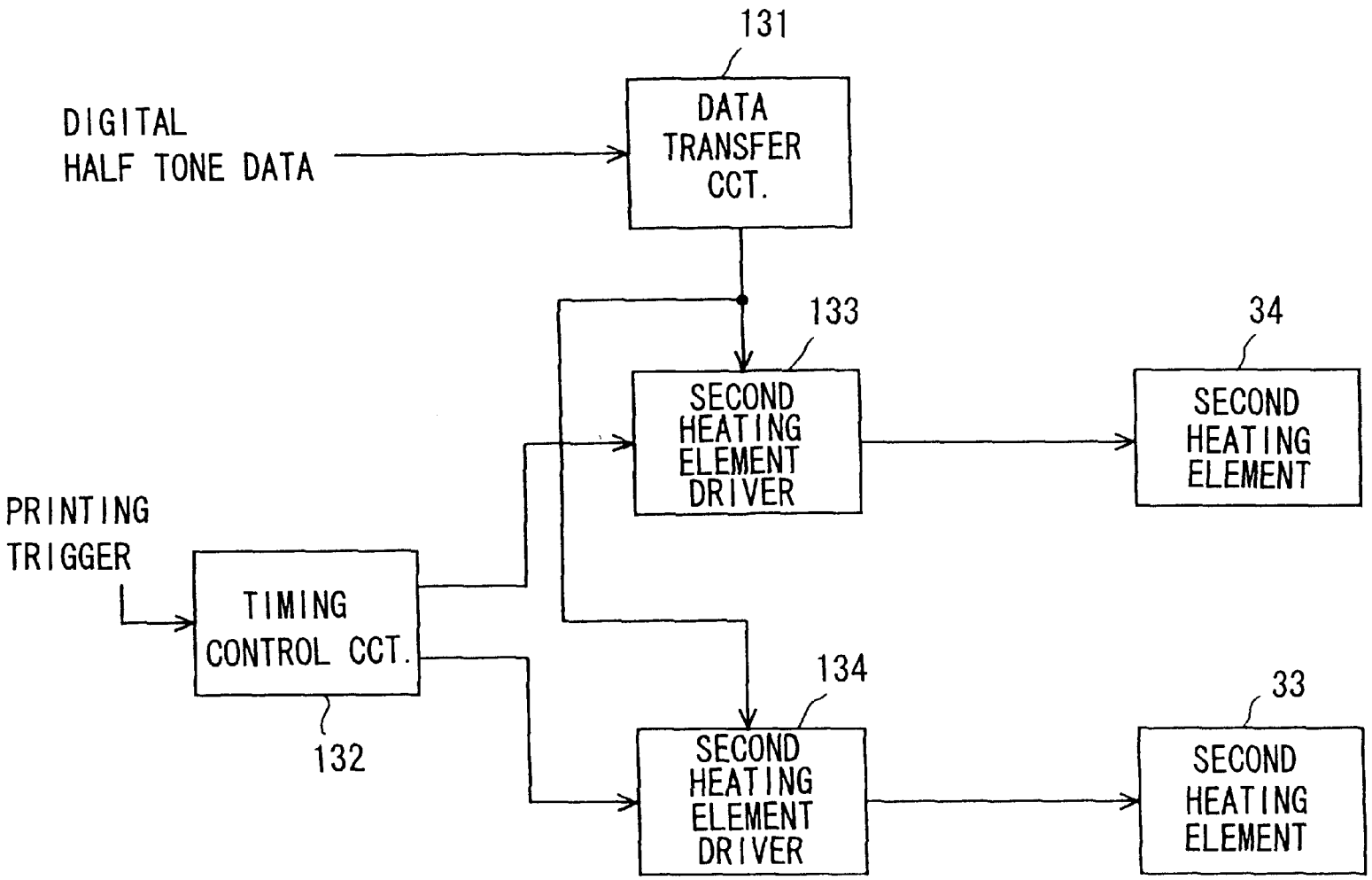
FIG. 30 is a block diagram showing the driving circuit of the ink jet printer head of FIG. 24.

FIG. 30 shows the driving circuit of ink jet printer head according to this embodiment. Digital half tone data is supplied from other block and is sent to the second heating element driver 133 by a data transfer circuit 131. When the digital half tone data is under the predetermined threshold value, two heating elements 33, 34 are not driven. At the timing of discharge, discharge a trigger is outputted from other block, which is detected by a timing control circuit 132, and the second and first heating element enable signals are outputted to the second and first heating element driver 133 and 134 respectively, at a predetermined timing. Respective signals are outputted at a timing as shown in FIGS. 29A and 29B.

In case that the ink 32 is mixed with the transparent solvent 32, the discharge of the ink can be eliminated on demand. In this embodiment, when the digital half tone data is under the predetermined threshold value, both of ink quantification and discharge are not performed, that is, nothing is printed. However, the discharge can be constantly performed, that is, the printing can be constantly performed. In this case, the transparent solvent 31 is printed to express white.

Further, in this embodiment as described above in FIGS. 29A, 29B and 30, the quantification of ink 32 is performed by changing the driving pulse width to the second heating element 34, but there is a method that the voltage value of the driving pulse is changed as described above. Each size in ink jet printer head of this embodiment is as follows: the heating elements 33, 34 are 60 by 60 [μm] square; the orifices 35, 36 are 30 [μm] in diameter; the first and second cavities 39, 40 are 105 [μm] in diameter and 35 [μm] in depth; the section of the mixing channel 38 is 10 by 10 [μm] square; and the mixing portion 37 is 75 [μm] in diameter and 25 [μm] in depth.

Figure 31:
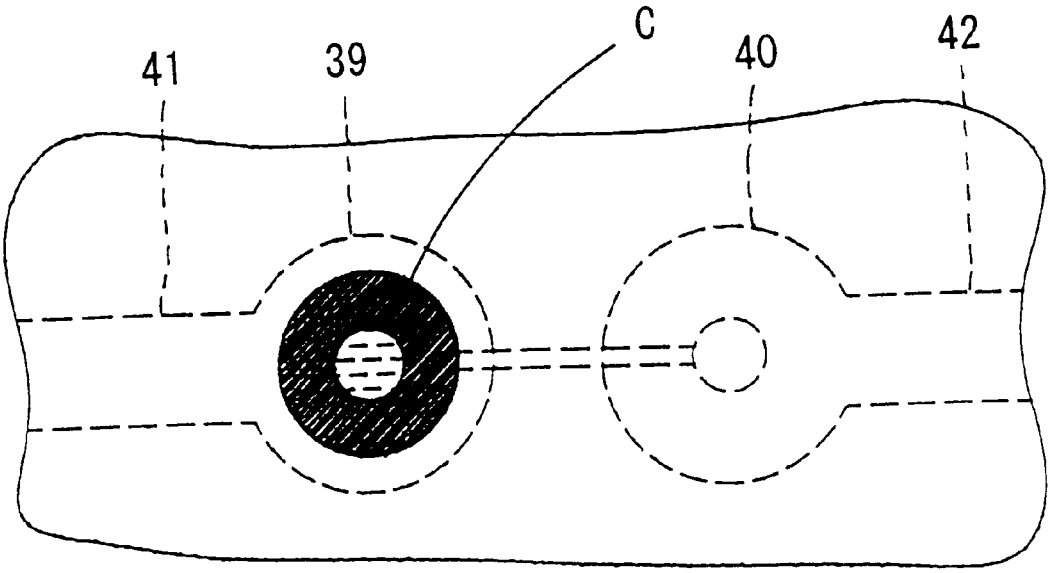
FIG. 31 is a front view showing the water repellency processing of an orifice plate of the ink jet printer head of FIG. 24.
Figure 32:
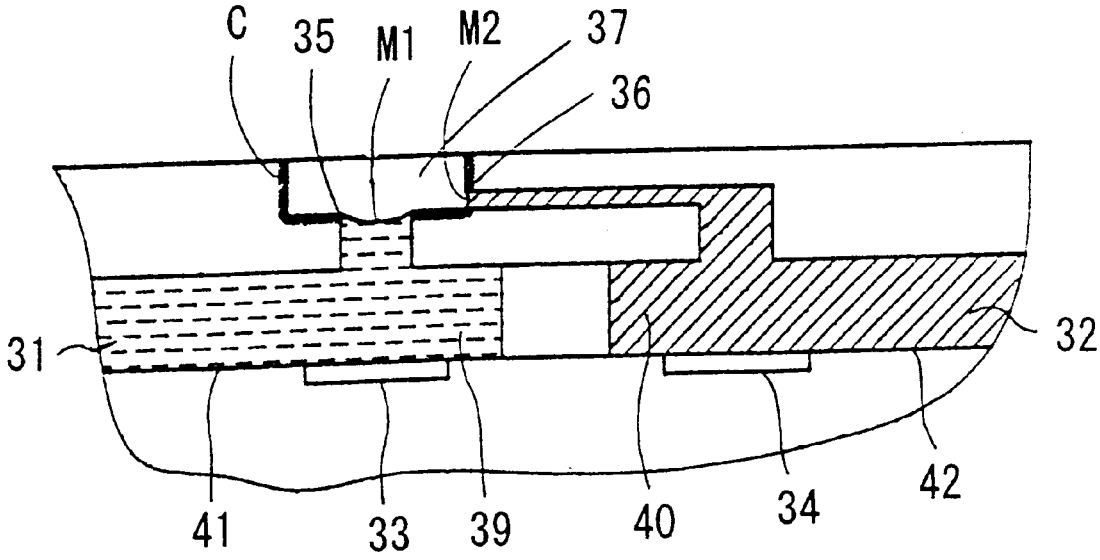
FIG. 32 is a sectional view showing the water repellency processing of an orifice plate of the ink jet printer head of FIG. 25.

Further, a water repellency processing is performed on the orifice plate. As shown in FIGS. 31 and 32, by performing the water repellency processing on at least only the surface C of the mixing portion 37 (slant line in figure), the meniscus M1, M2 of the transparent solvent 31 and the ink 32 are stable and the orifices 35, 36 can be formed, so that the ink 32 and transparent solvent 31 are prevented from unnecessary spontaneous mixing. The water repellency processing is performed by coating the walls of the mixing portion of chamber 37 with, a water repellent material such as for example, a fluororesin. The water repellency processing can be performed not only on the surface C but on whole orifice plate or a part of orifice plate including the surface C.

Figure 33:
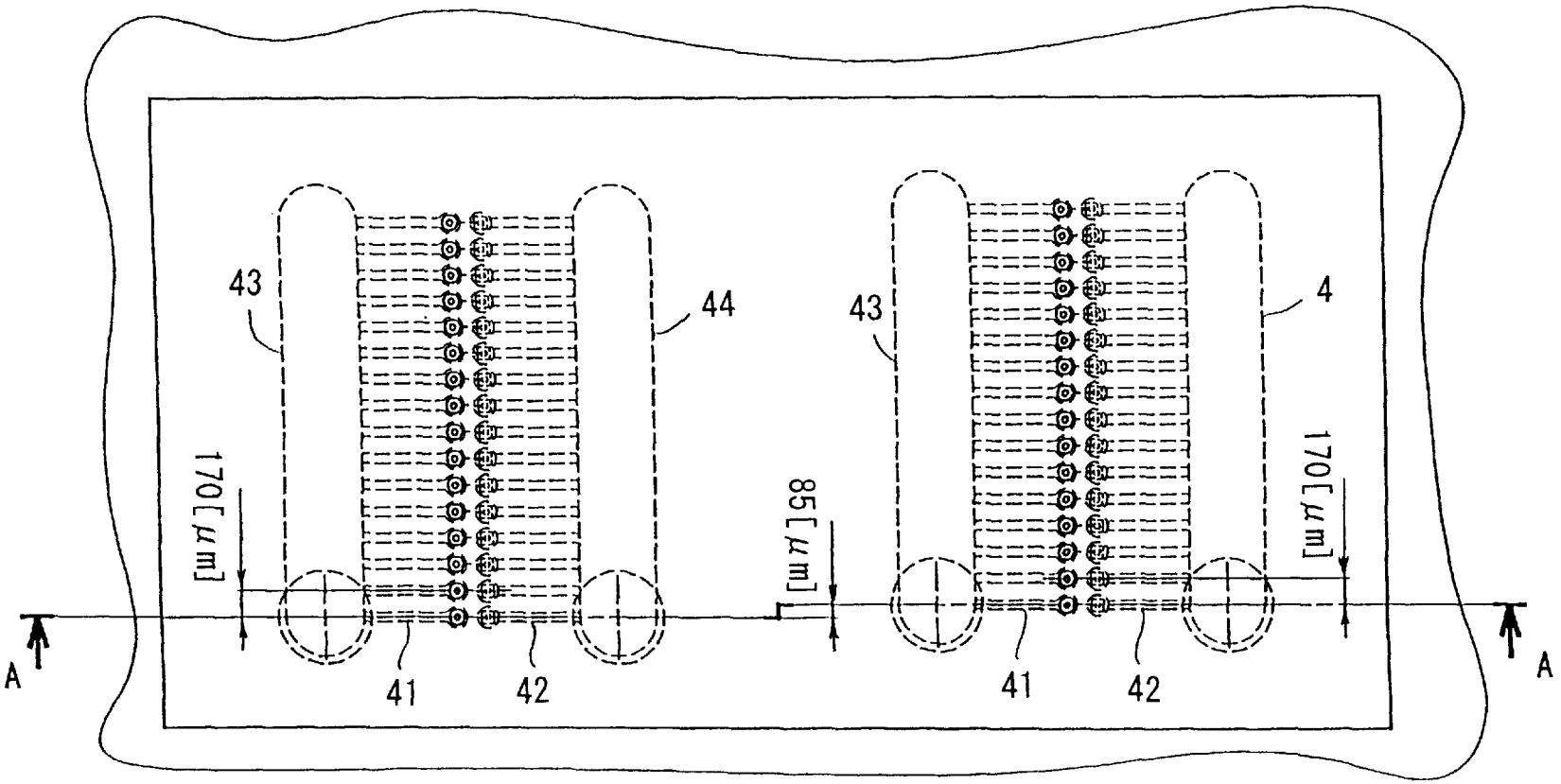
FIG. 33 is a front view showing the construction of the multi-nozzle ink jet printer head of FIG. 24 as viewed from the printing surface.
Figure 34:
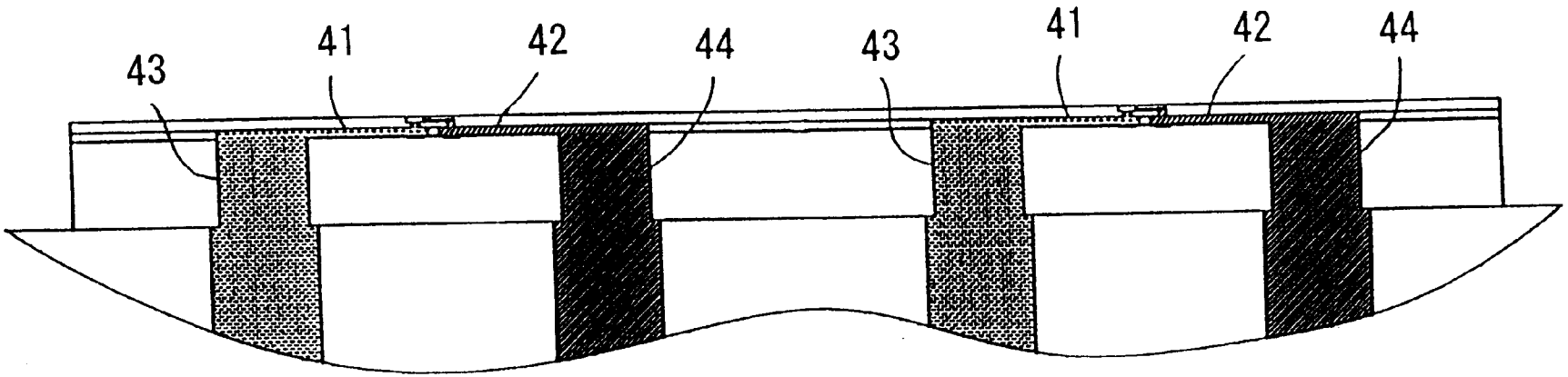
FIG. 34 is a right-side view showing the construction of the ink jet printer head of FIG. 33.

FIGS. 33 and 34 show the multiple-nozzle construction of ink jet printer head according to a third embodiment. The ink jet printer head in this embodiment has the same basic construction as the ink jet printer head in FIGS. 24 and 25. Here, thirty-two ink jet printer heads are provided in two rows in which a pair of sixteen ink jet printer heads each having the construction of FIGS. 24 and 25 are arranged in line.

Each ink jet printer head pitch is 170 [μm] as shown in FIGS. 33 and 34, and the left set of ink jet printer head group is shifted by a half pitch of 85 [μm] from the right set of ink jet printer head group. Therefore, one scan can perform a record of 32 dot (about 2.7 [mm] width) which is 12 dot (300 [dpi]) for 1 [mm]. In respective right and left sets, the first connection groove 43 and the second connection groove 44 provided on the head tip T have long hole to which sixteen first supplying groove 41 and sixteen second supplying groove 42 are connected.

Figure 35:
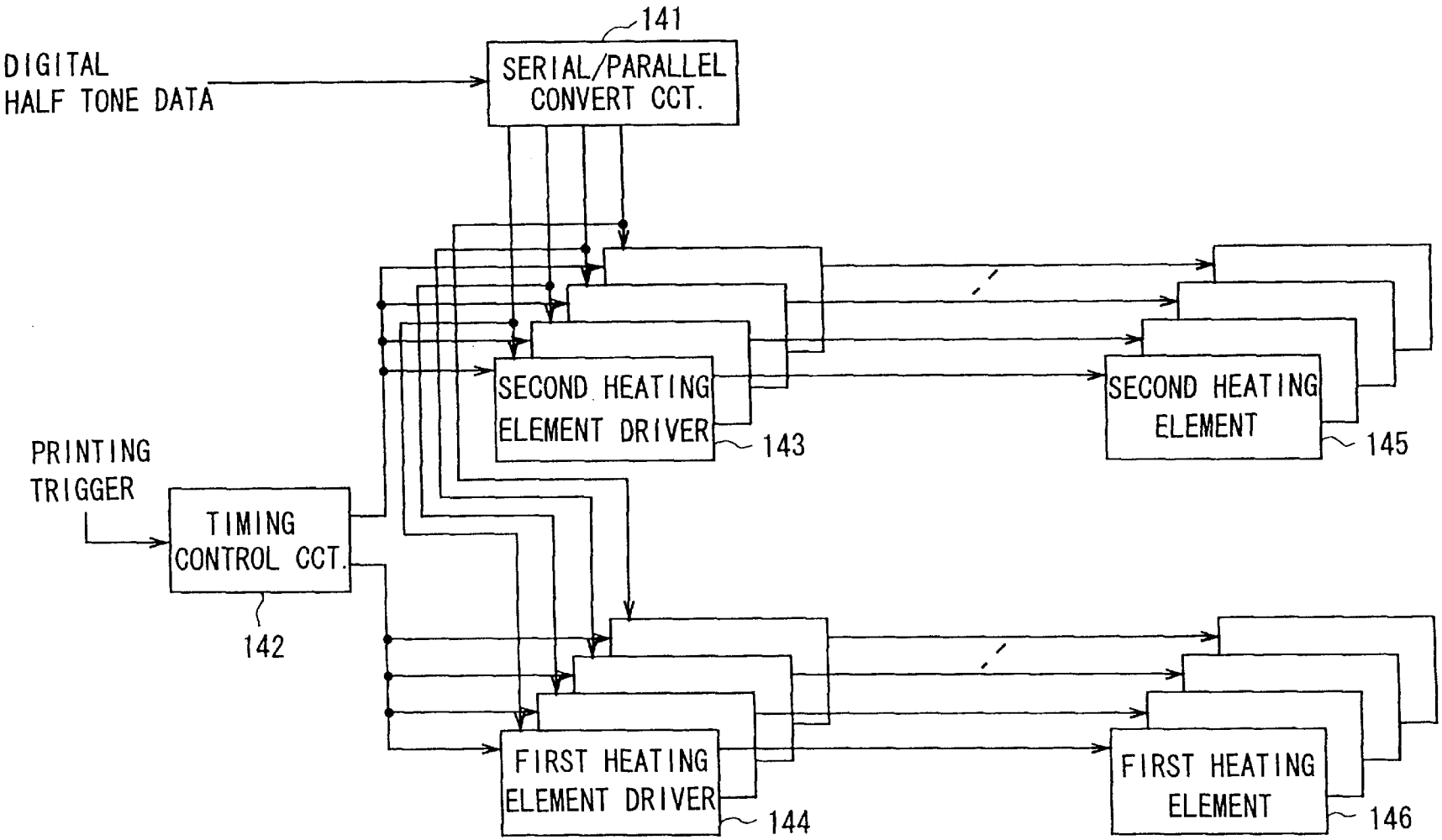
FIG. 35 is a block diagram showing the driving circuit of the ink jet printer head of FIG. 33.

The operation of ink jet printer head is the same as the ink jet printer head of FIGS. 24 and 25, and it operates in accordance with the operation principle of FIG. 28 and the timing chart of FIG. 29. FIG. 35 shows the block diagram of the driving circuit of the ink jet printer head. A half tone digital data is supplied from the other blocks, and sent to each second heating element driver 143 by the serial/parallel converting circuit 141.

At the printing timing, the printing trigger is outputted from the other blocks, and then is detected by the timing control circuit 142 to respectively output the second heating element enable signal and the first heating element enable signal to the second heating element driver 143 and the first heating element driver 144 at a predetermined timing.

Each second heating element 145 is controlled by the second heating element driver 143 in accordance with the second heating element enable signal, thereby a predetermined amount of ink is supplied from the second orifice 36 to the mixing portion 37. On the other hand, each first heating element 146 is controlled by each first heating element driver 144 in accordance with the first heating element enable signal, so that the transparent solvent and ink are discharged and simultaneously mixed.

(2-2) The method for manufacturing ink jet printer head

Figure 36A:
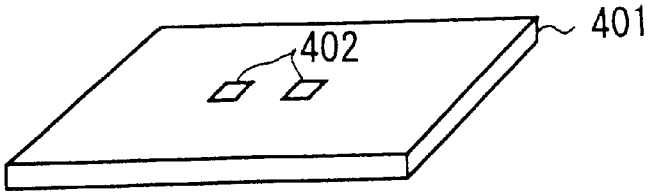
FIGS. 36A to 36E are schematic perspective views showing the steps involved in fabricating the ink jet printer head of FIG. 24.
Figure 36B:
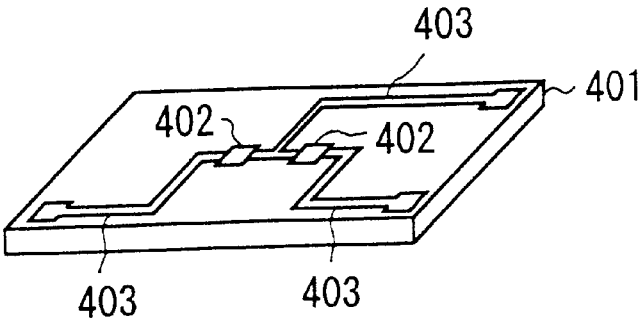
Figure 36C:
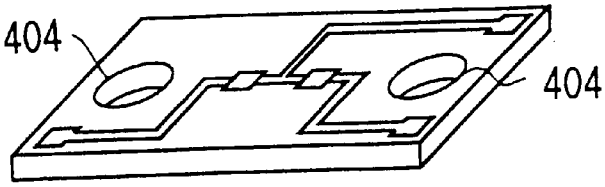
Figure 36D:
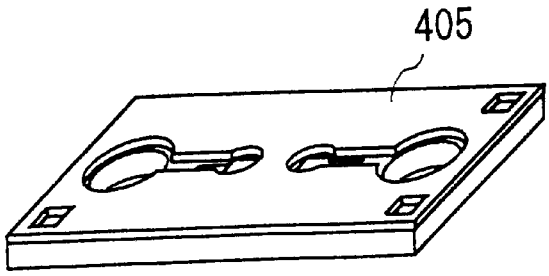
Figure 36E:
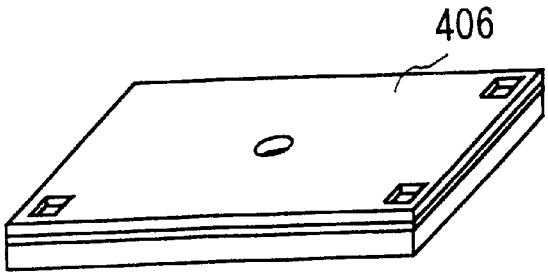

Next, a method for manufacturing ink jet printer head according to this embodiment will be described below. FIGS. 36A to 36E show the processing and assembly process. First, a heating resistor 402 such as $ZrB_2$ and TaAl and an electrode 403 such as aluminum and copper are formed on a substrate 401 such as Si or an aluminum oxide by selection etching. The surface is covered with a protection layer such as $SiO_2$ if necessary (FIGS. 36A and 36B). Next, a through-type hole 404 is processed on the substrate 401 by ultrasonic processing (FIG. 36C). Then, a dry film resist 405 (35 [mm] thickness in the embodiment) is laminated to the substrate 401, and a photo mask having a specific pattern is superimposed to be exposed. Thereafter, a portion of dry film photo resist 405 which is not exposed, is melted and removed using a specific developing solution, and the intermediate goods is obtained (FIG. 36D). Lastly, as shown in FIG. 36E, the orifice plate 406 is heat laminated or adhered, so as to finish the head tip T.

Figure 37E:
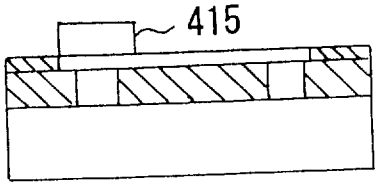
FIGS. 37A to 37H are schematic perspective views depicting the steps involved in fabricating the orifice plate of the ink jet printer head of FIG. 24.
Figure 37F:
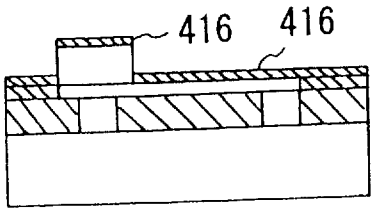
Figure 37G:
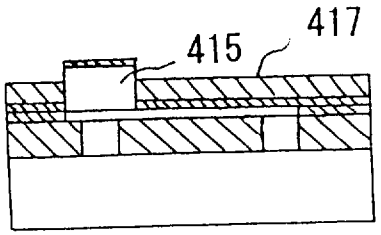
Figure 37H:
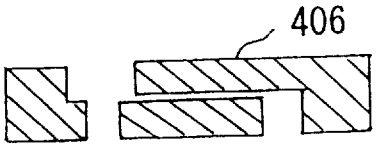
Figure 37A:
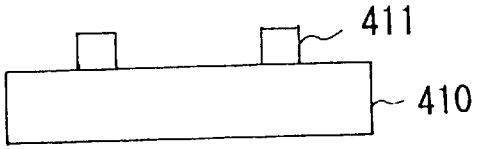
Figure 37B:
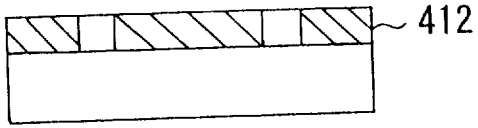
Figure 37C:
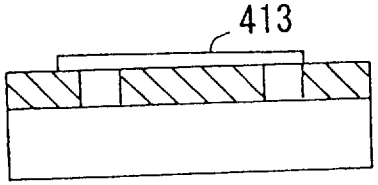
Figure 37D:
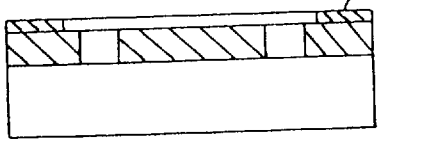

FIGS. 37A to 37H show the method for manufacturing the orifice plate 406. The orifice plate 406 is manufactured based on the electroforming. A base metal 410 such as stainless-steel is laminated with a dry film resist or is coated with a liquid resist, and is exposed and developed to obtain a resist pattern 411 (FIG. 37A). Ni is electroformed (electroplating) with the same thickness as the dry film to obtain the Ni pattern 412 (FIG. 37B). Thereon, the Ni pattern 412 is laminated with the dry film or is coated with the liquid resist which have 10 [$\mu$m] thickness each, and is exposed and developed so as to form the resist pattern 413 (FIG. 37C). Similar to FIG. 37B, Ni is electroformed with the same thickness as the resist to obtain the Ni pattern 414 (FIG. 37D).

Further, the Ni pattern is laminated with the dry film resist or is coated with the liquid resist, and is exposed and developed to form the resist pattern 415 (FIG. 37E). Thereon, Ni film 416 is formed by spattering or vapor deposition (FIG. 37F). Ni is electroformed with the thickness which is less than the resist 415 to obtain the Ni pattern 417. Lastly, the resist is removed by the resist remover solution such as KOH or NaOH solution, and Ni is peeled from the base metal 410 to obtain the orifice plate 406 (FIG. 37H).

In this embodiment, Ni is used as a metal for electroforming. However, other metals such as copper or chromium or a combination including these can be used. Also, there is a case where gold plating is applied, at last, for preventing from corrosion. The diameter of the mixing portion 37 of orifice plate is larger than that of orifice 35, so as to prevent the transparent solvent 31 from invasion to the mixing portion 37 at waiting time for discharge, by utilizing capillary attraction. Therefore, there is no contact during the waiting time for discharge between transparent solvent 31 and as a result ink 32, and they do not spontaneously mix with one another.

Furthermore, the ink jet printer head in this embodiment is characterized in the construction that the channel for conducting ink 32 to the mixing portion 37 and the mixing groove 38 are provided in the orifice plate 406. Such a construction enables the ink 32 and transparent solvent 31 to mix immediately before discharge. As described above, the orifice plate 406 is heat laminated or adhered to the intermediate goods obtained in FIG. 36D, as shown in FIG. 36E, and the head tip T is formed. The head tip T is adhered to the base B as shown in FIGS. 24 and 25. In this way, the ink jet printer head is manufactured.

(2-3) The fourth embodiment of ink jet printer head

Figure 38A:
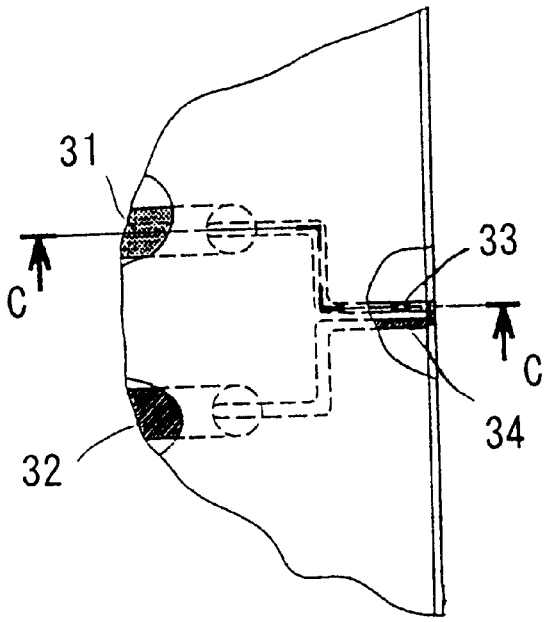
FIGS. 38A to 38C are schematic diagrams showing the construction of the fourth embodiment of an ink jet printer head according to this invention.
Figure 38B:
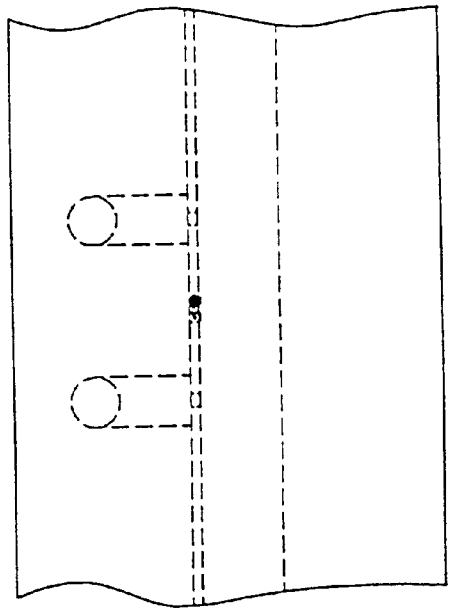
Figure 38C:
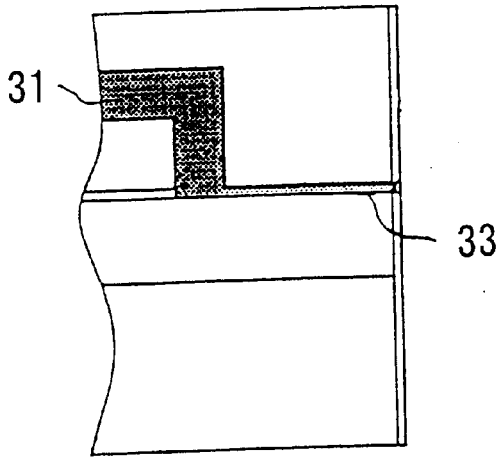
Figure 39A:
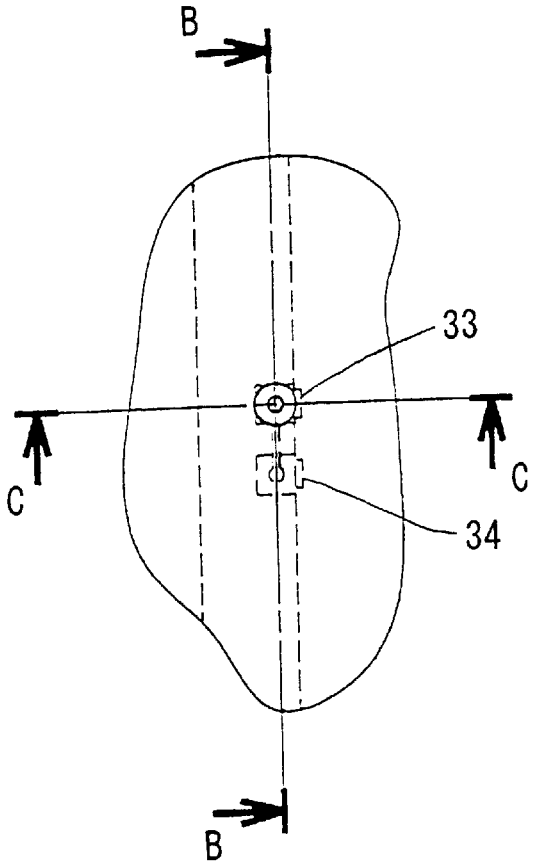
FIGS. 39A to 39C are enlarged schematic diagrams showing the nozzle portion of the ink jet printer head of FIGS. 38A to 38C.
Figure 39B:
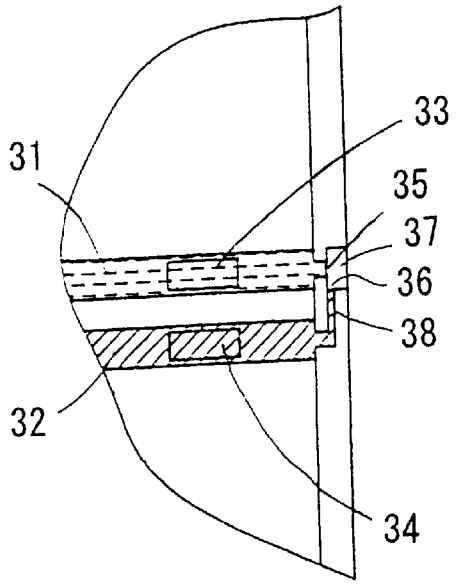
Figure 39C:
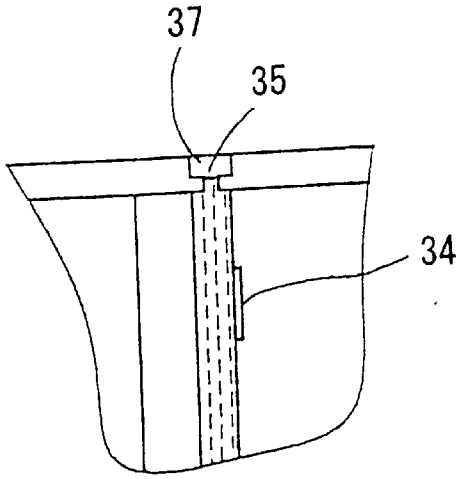
Figure 40A:
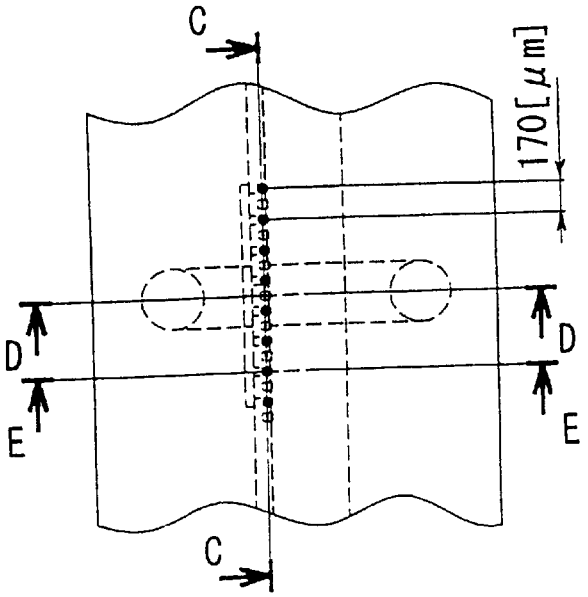
FIGS. 40A to 40E are schematic diagrams showing the construction of the multi-nozzle ink jet printer head of FIGS. 38A to 38C.
Figure 40D:
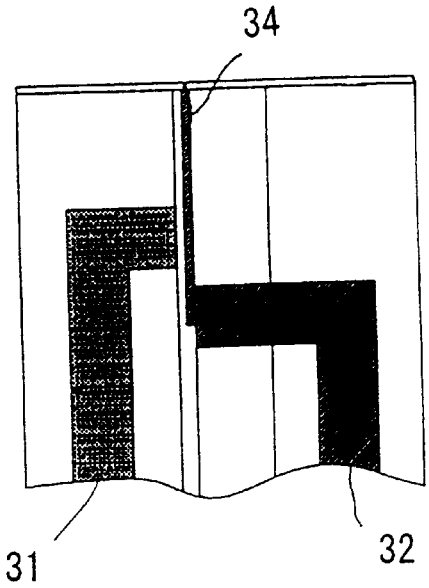
Figure 40B:
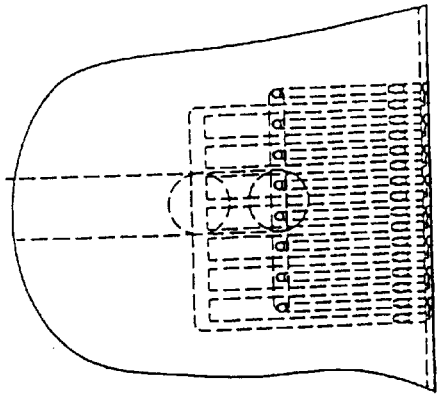
Figure 40E:
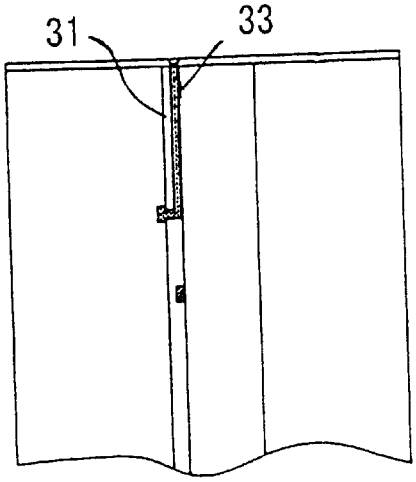
Figure 40C:
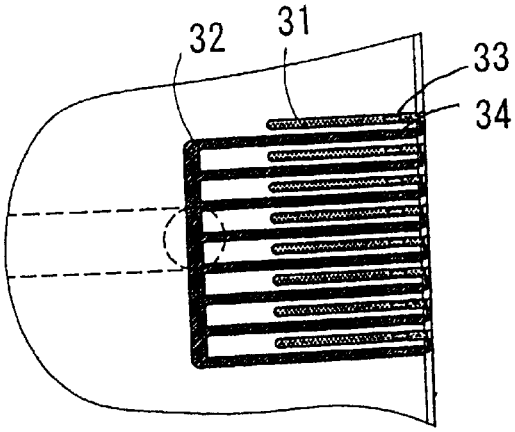

FIGS. 38A to 38C show the main portion of the fourth embodiment of ink jet printer head according to this invention; and FIGS. 39A to 39C show the enlarged discharging portion. The ink jet printer head shown in FIGS. 24, 25, 33, and 34 is called a side shooter type in accordance with the form of the heating elements 33, 34 which are provided. However, in this embodiment, the heating elements 33, 34 are such as to have a edge shooter type form. FIG. 38 shows the enlarged view of the discharging nozzle portion while FIG. 40 shows the multiple-nozzle embodiment. This example describes an arrangement having 8 nozzles. However, as will be readily understood the number of nozzle is not limited to 8.

Figure 41:
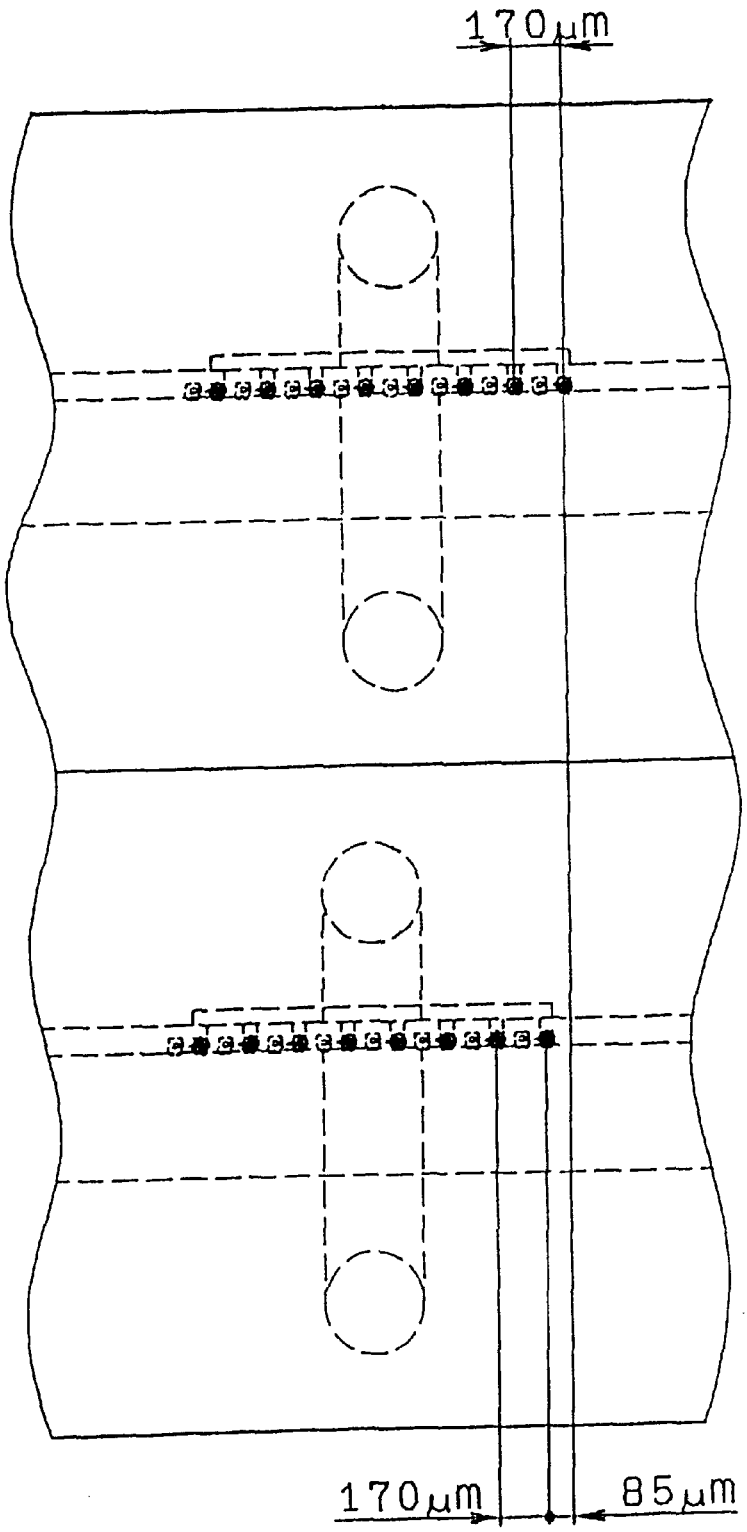
FIG. 41 is a plane view showing a method which allows a narrowing a nozzle pitch in the ink jet printer head of FIGS. 40A to 40E.

In FIG. 41, two multi-nozzle heads of FIGS. 40A to 40E are used in which the heads are shifted by a half pitch each other and the resolution and the number of nozzle is doubled. In FIGS. 40A to 40E, the pitch of orifice (first orifice) is 170 [$\mu$m] which corresponds to the resolution of about 6 [dot/mm] (150 [dpi]). As shown in FIGS. 31 and 32, the water repellency processing can be performed on the ink jet printer head of FIGS. 38A to 38C, 39A to 39C, 40A to 40D, and 41 as well as the ink jet printer head of FIGS. 24, 25, 33, and 34.

(2-4) Advantage of the third and fourth embodiments

In accordance with the above construction, the high gradation recording can be performed per pixel, so as to enable continuous gradation recording with high quality. Until the advent of this invention there has been a limit to how small a drop could be modulated, especially a drop having a low ink concentration. However, the embodiments of the invention can change the ink concentration of the drop freely, so as to enable a high quality gradation spanning a high concentration to a low concentration while keeping the size of the liquid drop small. Moreover, it is not necessary to use the suspected area gradation method such as dithering, and an ink jet printer head which can achieve the gradation without degrading resolution can be realized.

(3) Construction of Ink Jet Printer Head

Figure 42:
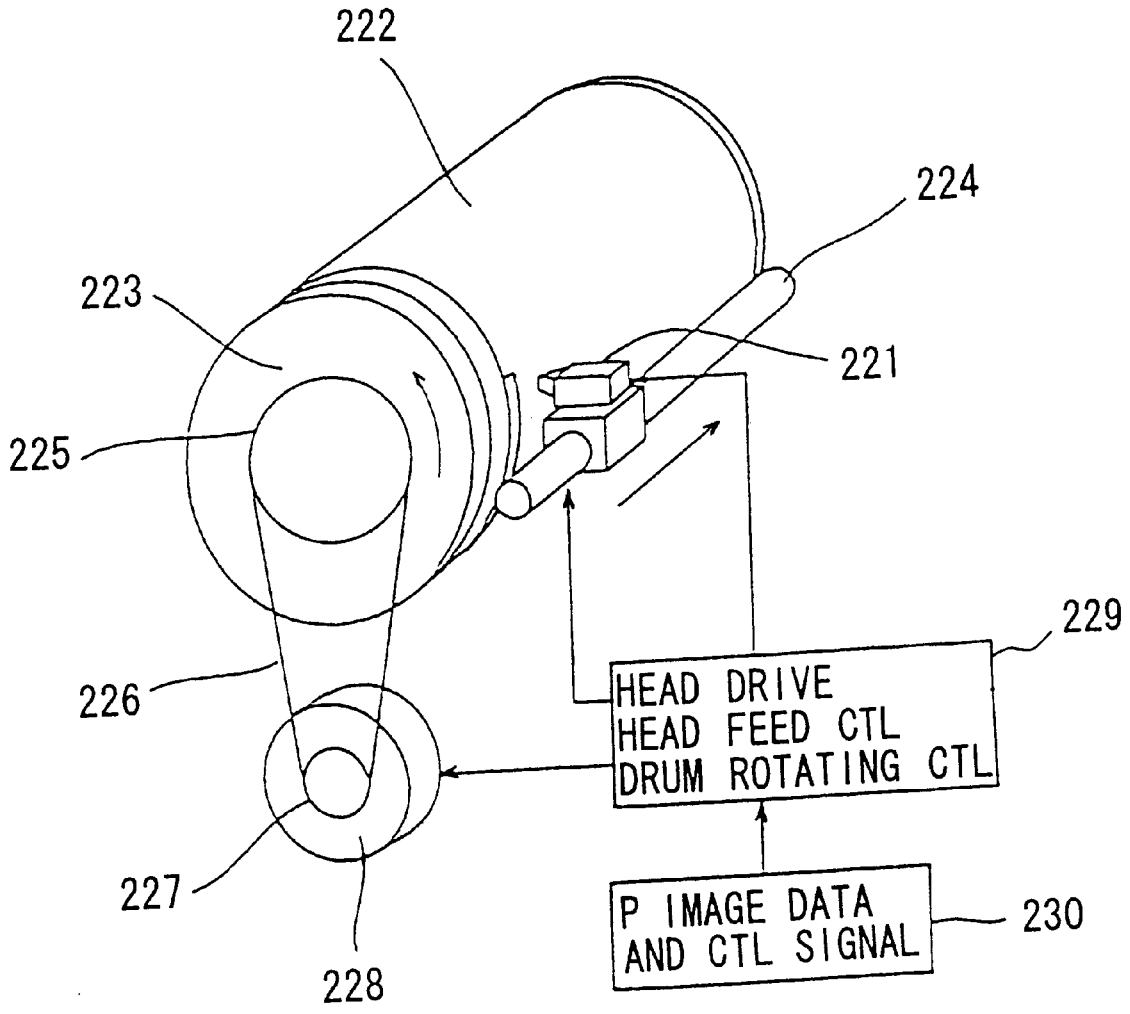
FIG. 42 is a schematic diagram showing the construction of a drum rotation ink jet printer head in which the ink jet printer of this invention is installed.
Figure 44:
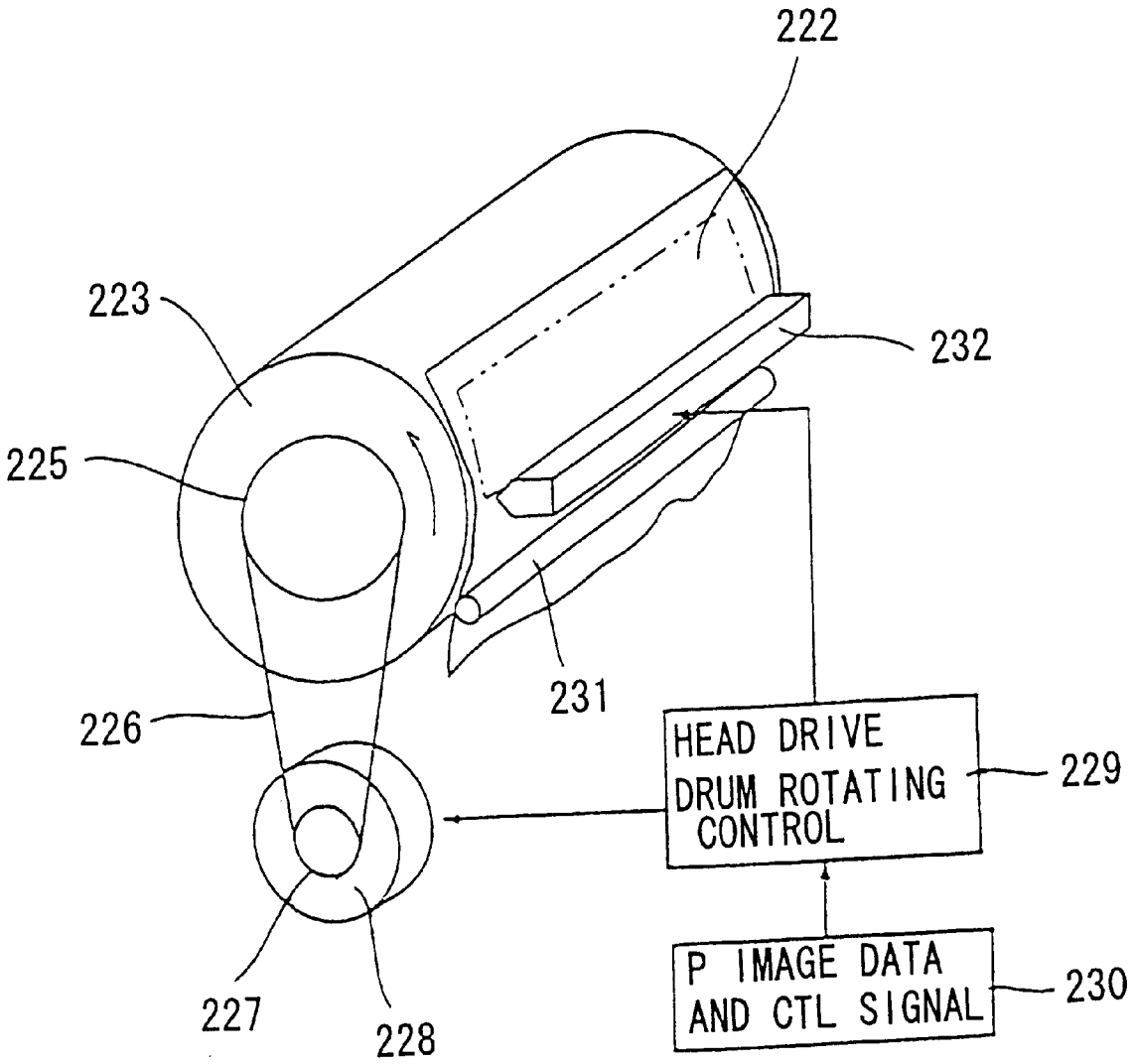
FIG. 44 is a schematic diagram showing the construction of a line ink jet printer in which the ink jet printer head of this invention is installed.

FIGS. 42 and 44 show the construction of ink jet printer in which an ink jet printer head is installed. FIG. 42 shows the construction of the drum rotation type of the ink jet printer. The printing paper 222 is wound around an external circumference of the drum 223 and fixed in a predetermined position. On the external circumference of the drum 223, a feed screw 224 is provided in parallel to the axial direction of the drum. A head 221 is threaded on the feed screw 224. The rotation of the feed screw 224 moves the head 221 in the axial direction. In addition, the drum 223 is rotated and driven by a motor 228 via a pulley 225, a belt 226, and a pulley 227. A drive controller 229 drives and controls the rotation of the feed screw 224 and the motor 228 and the drive of the head 221 based on printing data and a control signal 230.

In such a construction, when the drum 223 rotates, the head 221 discharges ink in synchronization with the rotation of the drum 223, thereby forming an image on the printing paper 222. When the drum 223 rotates one turn to complete printing of one row in the circumferential direction on the printing paper 222, the feed screw 224 rotates to move the head 221 by one pitch, thereby printing the next row. In such a case, there is another method available in which the drum 223 and the feed screw 224 are rotated at the same time to gradually move the head 221 while printing. On the one hand, in the case of a multiple-nozzle head and a construction for repetitive printing of the same section, such a step feed is appropriate. On the other hand, in the case of a single nozzle and a multiple nozzle having a few nozzles, the drum 223 and the feed screw 224 are associated with each other to perform spiral printing while rotating the drum 223 and the feed screw 224 at the same time.

Figure 43:
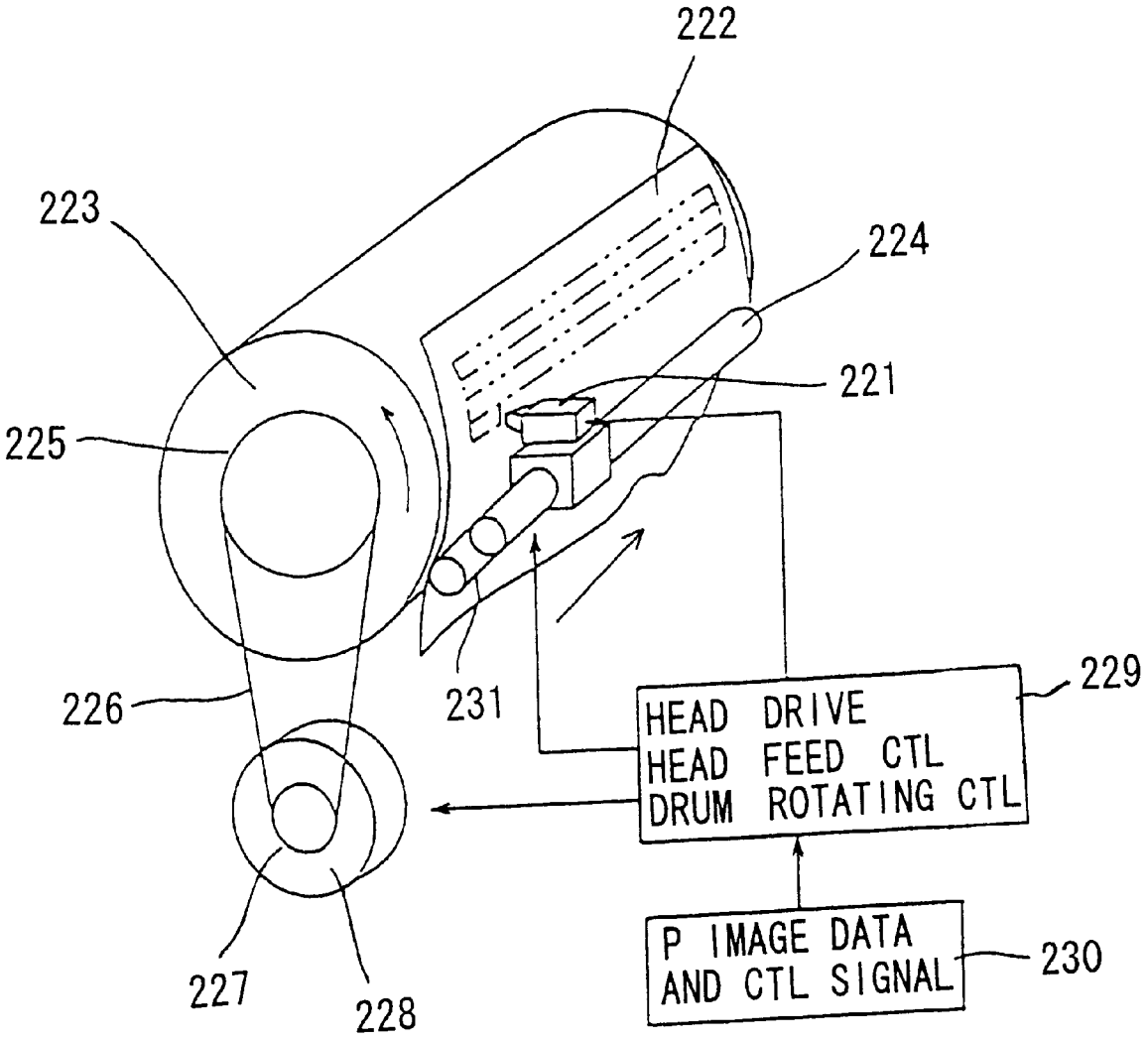
FIG. 43 is a schematic diagram showing the construction of a serial ink jet printer in which the ink jet printer head of this invention is installed.

FIG. 43 shows a construction of a serial ink jet printer. In such a case, the serial ink jet printer has approximately the same construction as the drum rotation printer shown in FIG.

42. The printing paper 222 is not wound around the drum 223. Instead the printing paper 222 is pressed and held against the drum 223 by a paper pressing roller 231 provided in parallel with the drum axis. In such a case, the drum 223 is rotated by one line to print the next line. The head 221 moves either in the same direction or in the reciprocal direction.

FIG. 44 shows a construction of a line ink jet printer. In this case, a line head 232 having a plurality of heads 221 arranged in a linear configuration is fixed and provided in the axial direction in place of a serial head 221 and the feed screw 224 shown in FIG. 43. In such a construction, the line head 232 prints one complete line at a time. Upon completion of the printing, the drum 223 is rotated by one line to print the next line. In this case, methods can be considered in which all of the lines are printed at one time, all of the lines are printed with dividing into a plurality of blocks, and all of the lines are printed alternately every other line.

Figure 45:
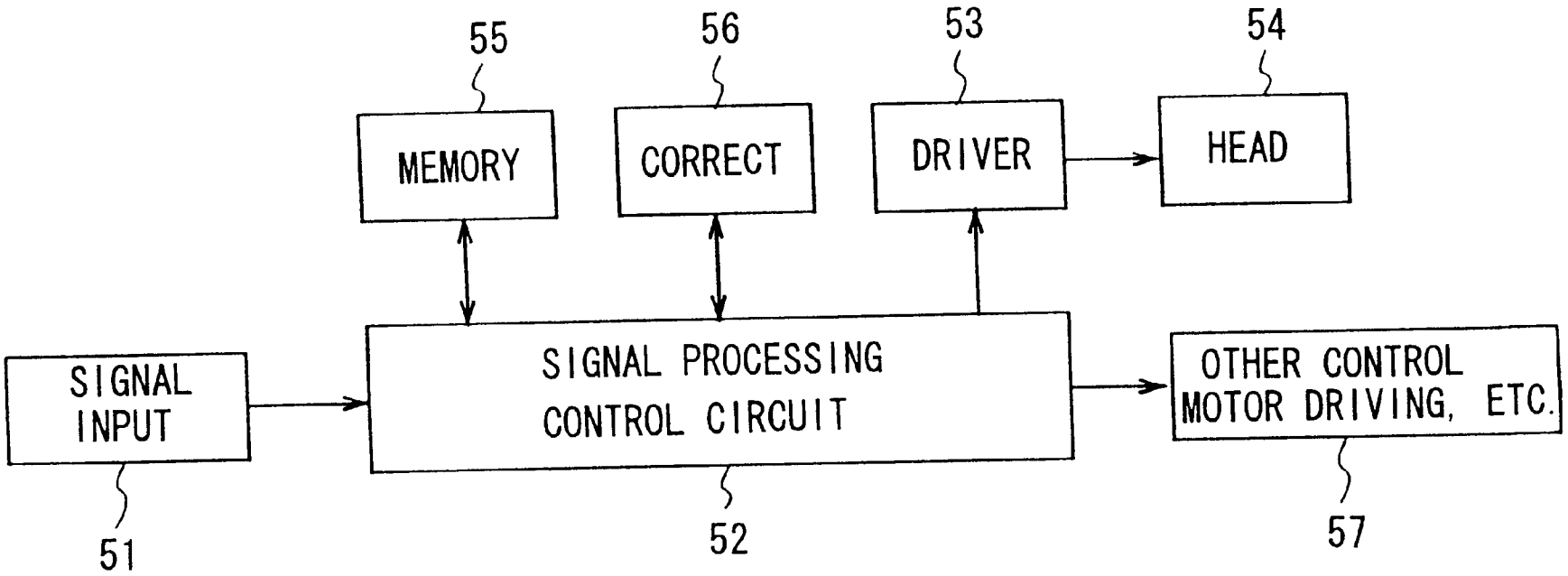
FIG. 45 is a block diagram showing the construction of a signal processing system and a control system in the ink jet printer.

FIG. 45 shows the construction of a printing and control system of the ink jet printer. A signal 51 such as printing data is entered into a signal processing control circuit 52 and is arranged in the printing order at the signal processing control circuit 52 and is transmitted to the head 54 via a driver 53. The printing order depends on the construction of the head and the printing section. Printing data is temporarily recorded in a memory 55 such as a line buffer memory or a one frame memory as needed, depending on the relationship to the input order of the printing data. A gradation signal and a discharge signal are output to the head 54.

Incidentally, if the multiple head has a large number of nozzles, an IC is installed on the head 54 to reduce the number of wires connected to the head 54. In addition, a correction circuit 56 is connected to the signal processing control circuit 52 to perform Y correction, color correction, and deviation correction for each head. The correction circuit 56 stores predetermined correction data in a ROM map mode. Generally, the correction circuit 56 is constituted so that the correction data is fetched in accordance with external conditions such as the nozzle number, temperature, and input signal.

Generally, the signal processing and control circuit 52 is composed of a CPU and a DSP to operate using software. The processed signal is sent to each type of controller 57. In each type of controller 57, a motor is driven and synchronized which rotates and drives the drum 223 and the feed screw 224. The head is cleaned and the feed and discharge of the printing paper 222 is controlled. In addition, it is to be noted that the signal 51 consists of an operation section signal and the external control signal.

(4) Other embodiments

In the aforementioned embodiments, arrangements have been described in which the transparent solvent is quantified and mixed with the ink. Instead, the ink and the transparent solvent may also be quantified and mixed. The same advantage as the aforementioned embodiment can be achieved by quantifying and mixing the ink and the transparent solvent to modulate the density of the liquid ink drop. In such a case, the construction and the operation of the ink jet printer head can be performed in the same manner as the aforementioned embodiments. However, as described above, the mixture ratio of the transparent solvent is on the order of 70[%], 50[%] at most. Consequently, on the one hand, the soft tone dot representation, or a representation in a highlighted area is limited. On the other hand, with respect to the shadowed area, this invention is advantageous since it is not necessary to increase the density of the ink in advance to obtain a sufficient density in the shadowed area as in the case where the ink is mixed with the transparent solvent.

In the aforementioned embodiments, the ink density of the liquid ink drop is modulated, but it is also possible to incorporate a method of modulating the size of the liquid ink drop per se with the above techniques. Incidentally, the aforementioned ink jet printer head allows the variation of the voltage value of the voltage pulse applied to the piezo element A for discharge, or a pulse width to change the size of the liquid ink drop. This enables a gradation recording having a wide dynamic range.

Figures 46A, 46B, 46C:
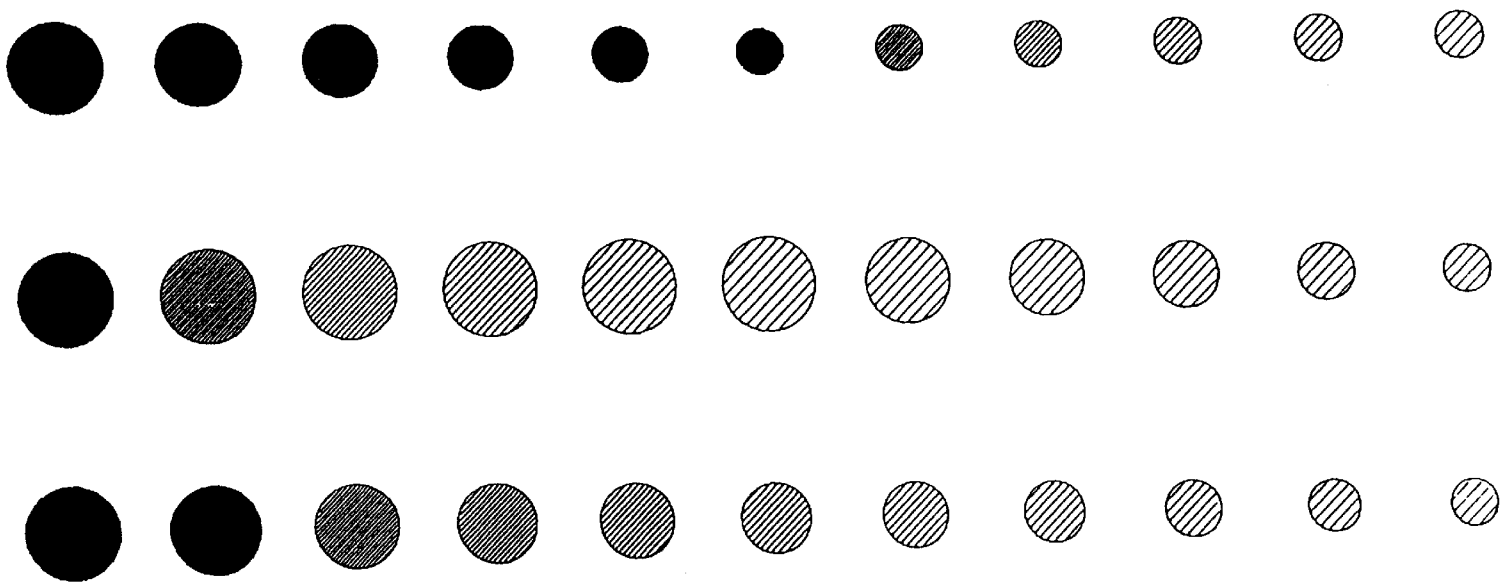
FIGS. 46A to 46C are schematic diagrams showing printing dots in which the density modulation and the area modulation of the dot are carried out using the ink jet printer head of this invention.

For example, as shown in FIG. 46A, a method can be used in which, with the density of the liquid ink drop being maximized, only the size of the liquid ink drop is reduced, with the result that when the size of the liquid ink drop reaches a minimum the density of the liquid ink drop may then be gradually reduced. Alternatively, as shown in FIG. 46B, with the size of the liquid ink drop being maximized, only the density of the liquid ink drop is gradually reduced, with the result that, when the liquid ink drop density lowers to a predetermined value, the size of the liquid ink drop then reduced. In addition, as shown in FIG. 46C, a method can be adopted in which both the density and the size of the liquid ink drop are reduced simultaneously.

While only a limited number of preferred embodiments of the invention, describes it will be obvious to those skilled in the art that various changes and modifications may be aimed, therefore, to cover all such changes and modifications as fall within the claimed true spirit and scope of the invention.

What is claimed is:

1. An ink jet printer head comprising:

a first orifice which is filed with a transparent solvent and which communicates with a mixing chamber that is initially empty;

a second orifice which is filled with an ink and which communicates with said mixing chamber;

a water repellent material applied to said mixing chamber;

means for quantifying and mixing said ink and said transparent solvent, said means for quantifying and mixing including first pressure generating means in communication with said second orifice and which causes an amount of ink to be discharged which is controlled in accordance with given density data, wherein said mixing chamber for mixing said transparent solvent and said ink receives said amount of ink after being discharged by said first pressure generating means; and means for discharging a liquid ink drop of a liquid mixed by said quantifying and mixing means, said means for discharging a liquid ink drop including a second pressure generating means, including a second heating element, in communication with said first orifice and which causes an amount of said liquid ink drop to be ejected from said mixing chamber.

2. An ink jet printer head comprising:

a first orifice which is filed with a transparent solvent;

a second orifice, which is filled with an ink, wherein an aperture area of said first or second orifice is set to a value which is less than that of the aperture area of said second or first orifice;

first unidirectional valve means for preventing uncontrolled intermixing of said ink and said transparent solvent, including a barrier membrane section comprising an opening having a size selected to produce a capillary effect, which is interposed between said second orifice and an empty location where said ink and said transparent solvent are to be mixed;

means for quantifying and mixing an ink and a transparent solvent, said means for quantifying and mixing including first pressure generating means in communication with said second orifice and which causes an amount of ink to be discharged to said empty location, and which is controlled in accordance with given density data;

means for discharging a liquid ink drop of a liquid mixed by said quantifying and mixing means, said means for discharging a liquid ink drop including a second pressure generating means in communication with said first orifice and which causes an amount of said liquid ink drop to be ejected.

3. An ink jet printer comprising:

an ink jet printer head comprising:

a location that is initially empty where an ink and a transparent solvent are to be mixed, wherein said location separates a supply of said ink from a supply of said transparent solvent;

means for quantifying and mixing said ink and said transparent solvent with the transparent solvent or the ink by controlling a first pressure generating means in communication with said supply of ink and which causes an amount of ink to be discharged to said location in accordance with given density data;

means for discharging a liquid ink drop by controlling a second pressure generating means in communication with said supply of transparent solvent and which causes an amount of said liquid ink drop to be ejected so that the drop travels toward a recording medium, wherein half tone printing is enabled by the density modulation of said liquid ink drop; and unidirectional valve means for preventing uncontrolled intermixing of said ink and said transparent solvent, including a barrier membrane section comprising an orifice having a size selected to produce a capillary effect, which is interposed between a source of said ink and a source of said transparent solvent.

4. An ink jet printer comprising:

an ink jet printer head comprising:

an empty location where an ink and a transparent solvent are to be mixed;

means for quantifying and mixing said ink and said transparent solvent by controlling a first pressure generating means which is in communication with said ink and comprises a first heating element and causes an amount of ink to be discharged to said empty location in accordance with given density data;

means for discharging a liquid ink drop mixed by said means for quantifying and mixing by controlling a second pressure generating means which is in communication with said transparent solvent and comprises a second heating element and causes an amount of said liquid ink drop to be ejected from said location;

a first orifice which is filled with said transparent solvent; and a second orifice which is filled with said ink and wherein an aperture area of said first or second orifice is set to a value which is less than that of the aperture area of said second or first orifice.

5. An ink jet printer head comprising:

an empty location where an ink and a transparent solvent are to be mixed;

quantifying and mixing means for separately quantifying said ink and said transparent solvent, and then mixing said transparent solvent and said ink together, including first pressure generating means, selected from a group consisting of a piezo element and a heating element, which causes an amount of ink in communication with said first pressure generating means to be discharged to said empty location, and which is controlled in accordance with given density data;

means for ejecting a liquid ink drop comprising a liquid mixed by said quantifying and mixing means, from said location, selected from a group consisting of a piezo element and a heating element, and in communication with said transparent solvent;

first unidirectional valve means, interposed between said location and a source of said ink, including a first barrier membrane section; and second unidirectional valve means, interposed between said location and a source of said transparent solvent, including a second barrier membrane section.

6. An ink jet printer head comprising:

a first orifice which is filed with a transparent solvent;

a second orifice which is filled with an ink;

an empty location where said ink and said transparent solvent are to be mixed, in communication with said first orifice and said second orifice;

means for quantifying and mixing said ink and said transparent solvent, said means for quantifying and mixing including first pressure generating means, in communication with said second orifice, and which causes an amount of ink to be discharged to a mixing chamber, and which is controlled in accordance with given density data;

means for discharging a liquid ink drop of a liquid mixed by said quantifying and mixing means, including a second pressure generating means, in communication with said first orifice, and which causes an amount of said liquid ink drop to be ejected from said location;

said mixing chamber, for mixing said transparent solvent and said ink, having a predetermined cylindrical configuration, said first orifice opening into a bottom surface of the cylindrically configured mixing chamber, and said second orifice opening into a side wall of the cylindrically configured mixing chamber; and first unidirectional valve means, interposed between said location and a source of said ink, including a first barrier membrane section; and second unidirectional valve means, interposed between said location and a source of said transparent solvent, including a second barrier membrane section.

7. The ink jet printer head according to claim 6, wherein;

said quantifying and mixing means and the first pressure generating means and the second generating means of said liquid discharge means use a combination of a piezo element and a piezo element, a heating element and a heating element, a piezo element and a heating element, or a heating element and a piezo element.

8. The ink jet printer head according to claim 6, wherein said quantifying and mixing means and said liquid discharge means are arranged to meter said ink and said transparent solvent in a manner wherein each liquid ink a drop is modulated in density and size.

9. The ink jet printer head according to claim 6, wherein;

said quantifying and mixing means is arranged so that one of said transparent solvent and said ink is quantified and introduced into said liquid discharge means before being mixed with the other of said ink and said transparent solvent.

10. The ink jet printer head according to claim 6, wherein;

a path for introducing said ink or said transparent solvent to said mixing room is provided in an orifice plate.

11. The ink jet printer according to claim 6, wherein;

the aperture area of said first or second orifice is set to a value which is less than half of the aperture area of said second or first orifice.

12. An ink jet printer comprising;

an ink jet printer head comprising:

a mixing chamber;

means for quantifying and mixing an ink and a transparent solvent by controlling a first pressure generating means which is in communication with said ink and causes an amount of ink to be discharged to said mixing chamber, and which is controlled in accordance with given density data;

means for discharging a liquid ink drop mixed by said quantifying and mixing means, by a controlling second pressure generating means which is in communication with said transparent solvent and causes an amount of said liquid ink drop to be ejected from said mixing chamber;

a first orifice which is filled with said transparent solvent; and a second orifice which is filled with said ink, wherein said mixing chamber is in fluid communication with the first and second orifices for mixing said transparent solvent and said ink, said mixing chamber having a predetermined cylindrical shape, said first orifice communicating with a bottom surface of the mixing chamber, and said second orifice communicating with a side surface of the mixing chamber.

13. The ink jet printer according to claim 12, wherein;

in said ink jet printer head, said quantifying and mixing means and the first and second pressure generating means of said liquid discharge means use a combination of a piezo element and a piezo element, a heating element and a heating element, a piezo element and a heating element, and a heating element and a piezo element.

14. The ink jet printer according to claim 12, wherein;

quantifying and mixing means is arranged so that one of said transparent solvent and said ink is introduced before quantifying and mixing with the other of said ink and said transparent solvent.

15. The ink jet printer according to claim 12, wherein;

said quantifying and mixing means is arranged so that the liquid ink drop is modulated in density and size.

16. The ink jet printer according to claim 12, further comprising:

unidirectional valve means for preventing uncontrolled intermixing of said ink and said transparent solvent, which comprises a projecting section in a panel-like substrate and radial slit in said projecting section.

17. An ink jet printer comprising:

an ink jet printer head comprising:

a mixing chamber that is initially empty;

means for quantifying and mixing an ink and a transparent solvent by controlling a first pressure generating means which is in communication with said ink and causes an amount of ink to be discharged to said mixing chamber, and which is controlled in accordance with given density data;

means for discharging an liquid ink drop mixed by said means for quantifying and mixing, by a controlling second pressure generating means which is in communication with said transparent solvent and causes an amount of said liquid ink drop to be ejected from said mixing chamber;

a first orifice which is filled with said transparent solvent;

a second orifice which is filled with said ink; and a water repellent material applied to said mixing chamber;

wherein said mixing chamber is in fluid communication with the first and second orifices, and a path for introducing said ink or said transparent solvent to said mixing chamber is provided in an orifice plate.

18. The ink jet printer according to claim 17, wherein;

the aperture area of said first or second orifice is set to a value which is less than half of the aperture area of said second or first orifice.

19. An ink jet printer head comprising:

a mixing portion;

a first source of ink which fluidly communicates with said mixing portion;

a second source of solvent which fluidly communicates with said mixing portion;

flow control means interposed between at least one of the first and second sources and said mixing portion, for normally preventing the ink and the solvent from mixing in said mixing portion;

first pressure generating means, associated with said first source, and comprising one of a heater element and a piezoelectric element, generating a pressure which causes an amount of ink to be discharged into said mixing portion, wherein said mixing portion is empty until said ink is discharged;

a second pressure generating means, associated with said second source for causing an amount of solvent to be mixed with said ink, and ejected from said mixing portion after the ink has been discharged into said mixing portion and in a manner which carries the ink which has been discharged into the mixing portion, therewith.

20. An ink jet printer according to claim 19, wherein said flow control means comprises a unidirectional valve interposed between the first source and said mixing portion.

21. An ink jet printer head according to claim 19, wherein said mixing portion comprises a mixing chamber, and wherein said ink is an aqueous based ink and wherein said flow control means comprises a layer of water repellent material disposed on a wall of the mixing chamber in a manner to repel the aqueous based ink and inhibit entry of the aqueous based ink into the mixing chamber.

22. An ink jet printer head according to claim 19, wherein said second pressure generating means comprises one of a heater element and a piezoelectric element.

23. An ink jet printer head according to claim 19, wherein said flow control means is an orifice having a size selected to produce a capillary effect.

24. An ink jet printer, comprising:

an ink jet printer head comprising:

a mixing portion;

a first source of ink which fluidly communicates with said mixing portion;

a second source of solvent which fluidly communicates with said mixing portion;

flow control means interposed between at least one of the first and second sources and said mixing portion, for normally preventing the ink and the solvent form mixing in said mixing portion;

first pressure generating means, associated with said first source, and comprising one of a heater element and a piezoelectric element, generating a pressure which causes an amount of ink to be discharged into said mixing portion, wherein said mixing portion is empty until said ink is discharged;

a second pressure generating means, associated with said second source for causing an amount of solvent to be mixed with said ink, and ejected from said mixing portion after the ink has been discharged into said mixing portion and in a manner which carries the ink which has been discharged into the mixing portion, therewith.

25. An ink jet printer according to claim 24, wherein said flow control means comprises a unidirectional valve interposed between the first source and said mixing portion.

26. An ink jet printer according to claim 24, wherein said mixing portion comprises a mixing chamber, and wherein said ink is an aqueous based ink and wherein said flow control means comprises a layer of water repellent material disposed on a wall of the mixing chamber in a manner to repel the aqueous based ink and inhibit entry of the aqueous based ink into the mixing chamber.

27. An ink jet printer according to claim 24, wherein said second pressure generating means comprises one heater element and a piezoelectric element.

28. An ink jet printer according to claim 24, wherein said flow control means is an orifice having a size selected to produce a capillary effect.

* * * * *